US006942554B1

(12) United States Patent
Mandina

(10) Patent No.: US 6,942,554 B1
(45) Date of Patent: Sep. 13, 2005

(54) APPARATUS AND PROCESS FOR POLISHING A SUBSTRATE

(75) Inventor: Michael P. Mandina, Rochester, NY (US)

(73) Assignee: Optimax Systems, Inc., Ontario, NY (US)

( * ) Notice: Subject to any disclaimer, the term of this patent is extended or adjusted under 35 U.S.C. 154(b) by 0 days.

(21) Appl. No.: 10/623,958

(22) Filed: Jul. 21, 2003

Related U.S. Application Data

(60) Provisional application No. 60/397,729, filed on Jul. 22, 2002.

(51) Int. Cl.[7] ..... B24B 5/00

(52) U.S. Cl. ..... 451/165; 451/159; 451/170; 451/163

(58) Field of Search ..... 451/158, 159, 451/160, 163, 165, 170

(56) References Cited

U.S. PATENT DOCUMENTS

| | | | | |
|---|---|---|---|---|
| 3,534,506 | A * | 10/1970 | Soong et al. | 451/159 |
| 3,877,177 | A * | 4/1975 | Taniguchi | 451/159 |
| 3,889,426 | A * | 6/1975 | Blum | 451/159 |
| 4,232,485 | A * | 11/1980 | Eadon-Allen | 451/159 |
| 4,520,596 | A * | 6/1985 | Otto et al. | 451/159 |
| 5,403,227 | A * | 4/1995 | Franklin et al. | 451/168 |
| 5,447,464 | A * | 9/1995 | Franklin et al. | 451/28 |
| 6,390,903 | B1 * | 5/2002 | Takahashi et al. | 451/286 |
| 6,629,882 | B2 * | 10/2003 | Takahashi et al. | 451/286 |

* cited by examiner

*Primary Examiner*—M. Rachuba
(74) *Attorney, Agent, or Firm*—Howard J. Greenwald; Peter J. Mikesell

(57) ABSTRACT

An apparatus for polishing a substrate with an optical surface. The apparatus contains a polishing pad and and a device for oscillating the polishing pad while simultaneously contacting it with at least 90 percent of said optical surface.

20 Claims, 22 Drawing Sheets

APPARATUS AND PROCESS FOR POLISHING A SUBSTRATE

CROSS-REFERENCE TO RELATED APPLICATIONS

This application claims priority based upon U.S. Patent Application Ser. No. 60/397,729, filed on Jul. 22, 2002.

FIELD OF THE INVENTION

An apparatus for polishing a substrate in which a polishing pad is oscillated while it simultaneously contacts at least ninety percent of an optical surface.

BACKGROUND OF THE INVENTION

An optically functional surface of a lens for use in a camera or the like is sequentially processed by taking the steps of rough machining of a glass raw material, rough grinding, polishing, and fine polishing, with predetermined surface accuracy established for each step.

In these steps, a processing position in which a processing tool comes into contact on a lens surface to be processed and a surrounding area of the processing position are thoroughly supplied with polishing liquid including polishing abrasive grains.

Many types of lens polishing apparatuses have been developed in the past and have been used with varying degrees of success. These apparatus are believed to belong to two broad groups. The first group utilizes a lapping tool head having a resilient or flexible lapping membrane that is deformable upon contact with the surface of a lens to adapt to the curvature of the lens. Examples of apparatuses belonging to this first group are described in the following United States patents: U.S. Pat. No. 3,589,071 issued on Jun. 29, 1971 to Hans S. Hirshhorn; U.S. Pat. No. 5,205,083 issued on Apr. 27, 1993 to Dennis R. Pettibone; and U.S. Pat. No. 5,662,518 issued on Sep. 2, 1997 to Michael D. James et al. The entire disclosure of each of these United States patents is hereby incorporated by reference into this specification.

The second type of lens polishing apparatus of the prior art uses a plurality of plungers for applying pressure gradients over a lens polishing membrane. Although this apparatus is designed for polishing large telescope mirrors, this is the type of apparatus that is of interest herein. Examples of these apparatuses are illustrated in the following United States patents: U.S. Pat. No. 4,606,151 issued on Aug. 19, 1986 to Erich Heynacher; and U.S. Pat. No. 4,802,309 issued on Feb. 7, 1989 to Erich Heynacher. The entire disclosure of each of these United States patents is hereby incorporated by reference into this specification.

Another type of polishing apparatus that utilizes vibrational motion was developed mainly for polishing metals and utilizes a tool that only becomes conformal to the surface being processed after vibration occurs. This type of vibrational polishing method may work for rapid removal but does not deal with pre-existing signatures in the material. This type of apparatus is employed to polish any material more resistant to vibrational (sonic and ultrasonic) erosion than the material of which the tool is made. In this fashion, the tool will be re-dressed continuously and inherently to the complementary form of the work piece, by virtue of the fact that the tool will be eroded to a greater extent than the work piece. The preferential working of the tool results in a constant or even increasing conformity to the fine detail and resolution of the work piece, so that, as polishing of the work piece occurs, there is no loss of resolution. Examples of these apparatuses are illustrated in U.S. Pat. No. 5,187,899 issued on Feb. 23, 1993 to Lawrence J. Rhoades. The entire disclosure of this United States patent is hereby incorporated by reference into this specification.

Other types of related polishing apparatuses for use with quartz, glass, ceramics, metals, and plastics have applied the ultrasonic energy directly to the substrate. While using a lapping tool over the surface being processed, the result is a half wave resonance at that first surface. An example of these apparatuses is illustrated in U.S. Patent: U.S. Pat. No. 5,551,907 issued on Sep. 3, 1996 to Dave Sandeep. The entire disclosure of this United States patent is hereby incorporated by reference into this specification.

After a surface has been ground to a specific form, that form can be monitored throughout the manufacturing process by periodically monitoring roughness values such as the Rt or Ra of the surface.

Rt is a common measure of roughness used in the abrasives industry; however, the exact measuring procedure can vary with the type of equipment utilized in surface roughness evaluation. Rt measurements are based on procedures followed with the Rank Taylor Hobson profilometer located in Leicester, England, available under the trade designation "SURTRONIC 3." Within the Rank Taylor Hobson purview, Rt is defined as the maximum peak-to-valley height within an assessment length set by the Rank Taylor Hobson instrument. Rt is the average, measured over five consecutive assessment lengths, of the maximum peak-to-valley height in each assessment length. Rt is measured with a profilometer probe which, for the SURTRONIC 3, is a 5 micrometer radium diamond tipped stylus; and the results are recorded in micrometers (um). For a further discussion of such "Rt" term, reference maybe had, e.g., to U.S. Pat. Nos. 5,873,770, 5,888,119, 6,110,015, 6,194,317, 6,231,629, and the like. The entire disclosure of each of these United States patents is hereby incorporated by reference into this specification.

Ra is defined as an average roughness height value of an arithmetic average of the departures of the surface roughness profile from a mean line on the surface, also measured in micrometers (um). Reference may be had, e.g., to U.S. Pat. Nos. 5,876,268, 5,989,111, 6,042,928, 6,086,977, 6,155,910, and the like. The entire disclosure of each of these United States patents is hereby incorporated by reference into this specification.

After a surface has been rough ground, it is polished and then fine polished. For glass-surface polishing, it is preferred that average particle size of the abrasive particles is from about 0.001 to 20 micrometers, typically between 0.01 to 10 micrometers. In some instances, the abrasive particles preferably have an average particle size less than 0.1 micrometer. In other instances, it is preferred that the particle size distribution results in no or relatively few abrasive particles that have a particle size greater than about 2 micrometers, preferably less than about 1 micrometer and more preferably less than about 0.75 micrometers. At these relatively small particle sizes, the abrasive particles may tend to aggregate by interparticle attraction forces. Thus, these aggregates may have a particle size greater than about 1 or 2 micrometers and even as high as 5 or 10 micrometers. It is then preferred to break up these aggregates to an average size of about 2 micrometers or less.

During processing, there are many machines that utilize tools that make a point or localized contact with the surface being processed.

The manner in which these machines remove material from the surface being processed causes signatures on that surface that are difficult and time consuming to thoroughly remove with conventional methods.

As used in this specification, the term "signature," refers to irregularities in the surface of the substrate caused by prior operations. Reference may be had, e.g., to U.S. Pat. Nos. 6,039,630, 6,396,995, and the like. The entire disclosure of each of these United States patents is hereby incorporated by reference into this specification.

As will be apparent to those skilled in the art, each particular operation tends to leave its own distinct signature. The presence of these signatures is undesirable, for they often affect the optical properties of the substrate.

Signatures left on and in the surface being processed up to and including the polishing step vary dramatically based on a number of variables, however, two general problems can be stated. In the case of rotationally symmetric aspheric surfaces, fine grinding, can leave subsurface damage, which results in longer polishing cycles. Point contact of tooling to the surface being processed in conjunction with opposed rotational motion commonly associated with the manufacturing of rotationally symmetric, aspheric lenses, results in sometimes broken annular rings (from a top view) that exist in the form of a wave pattern on the surface being processed. This wave pattern commonly referred to as midspatial roughness, ranges in wavelength from above 80 micrometers up to about 8000 micrometers depending on a variety of factors. It is the object of one aspect of this invention that this wave pattern be minimized as much and as quickly as possible.

Numerous attempts have been made to decrease the time necessary to obtain the desired surface finish and extend abrasive pad life during the polishing process. For instance, U.S. Pat. No. 5,014,468 (Ravipati et al.) discloses a lapping film intended for ophthalmic applications comprising an interconnected pattern imparted into a surface coating of abrasive particles dispersed in a radiation cured adhesive binder. The entire disclosure of this United States patent is hereby incorporated by reference into this specification.

One object of the present invention is to remedy the shortcomings of related techniques and to eliminate a specific scope of surface and subsurface related signatures, and to do so in the shortest amount of time possible.

SUMMARY OF THE INVENTION

In accordance with one aspect of the invention, there is provided a polishing apparatus that comprises a tool, pad, and backing assembly which oscillates in such a manner and at a predescribed frequency so as to break down the peaks of this wave signature without creating drastic changes in the overall form of or causing asymmetry in the surface being processed.

BRIEF DESCRIPTION OF THE DRAWINGS

The invention will be described by reference to the following drawings, in which like numerals refer to like elements, and in which.

DESCRIPTION OF THE PREFERRED EMBODIMENTS

Figure 1:
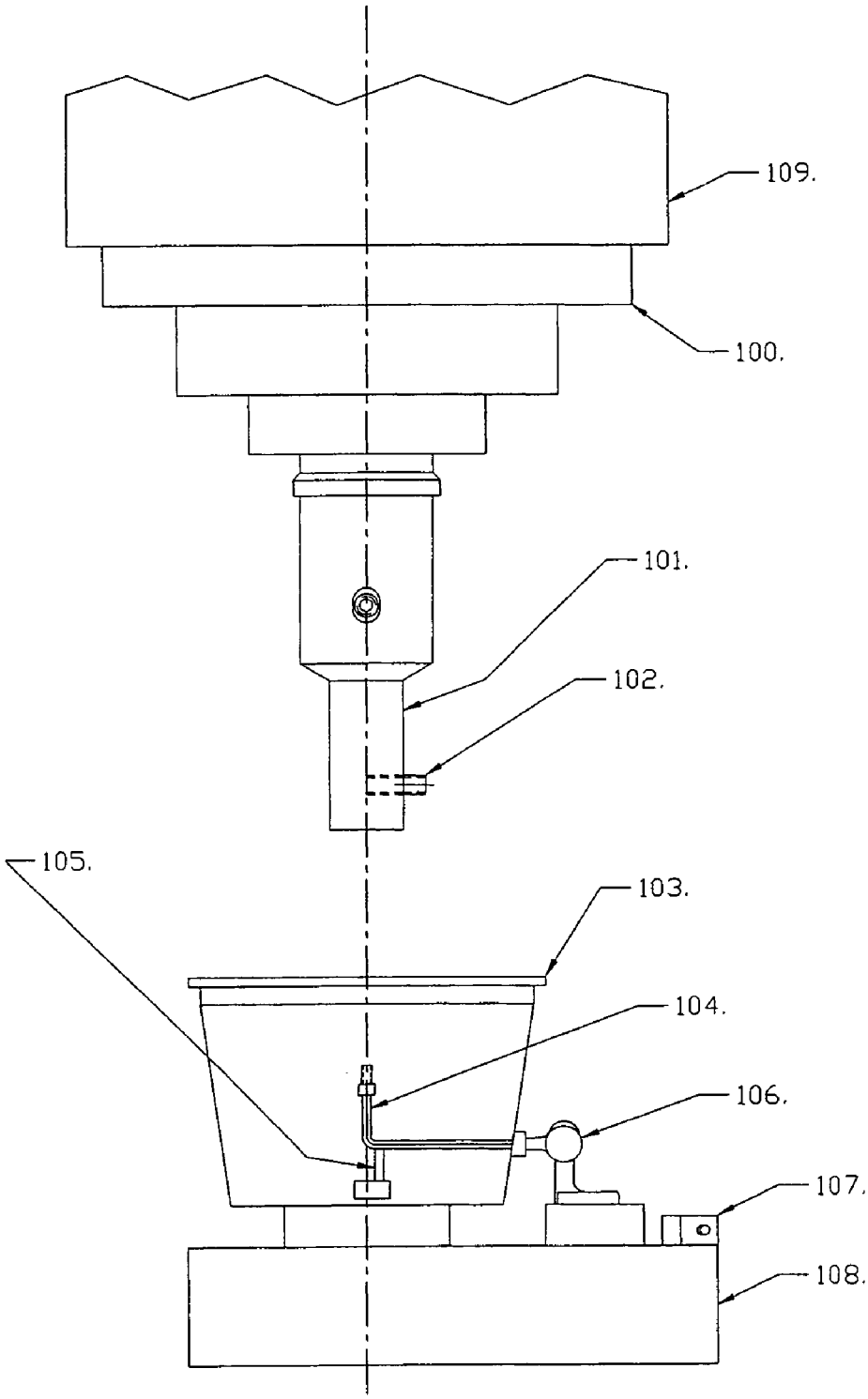
FIG. 1 is a schematic view of one preferred polishing machine.

In accordance with one aspect of the invention, there is provided a polishing apparatus that comprises a tool, pad, and backing assembly which oscillates in such a manner and at a frequency so as to break down the peaks of this wave signature without creating drastic changes in the overall form of or causing asymmetry in the surface being processed.

Without wishing to be bound any particular theory, applicant believes that the reason the form of the surface being processed remains fairly uniform throughout the process is due to this specified chemical-mechanical motion, short polishing cycles, as well as the nature of the pad and backing materials. Longer cycles at specified frequencies do cause finite changes in form. Being able to make changes in the form of the surface being processed allows for relief of subsurface damage where the tool makes contact with the surface being processed.

In accordance with another aspect of the present invention, the motion utilized may be composed of a linear or eccentric oscillatory motion. That linear motion, mounted perpendicular to the vertical axis at the center of the substrate, isolates the component of motion that specifically targets the annular signature. The possible eccentric motion aids in gross removal while maintaining some linear component so that the annular signature is minimized.

It will be understood that the actual time (or rate) necessary to polish a glass work piece to the desired surface finish will vary depending upon a number of factors, such as the polishing apparatus used, the size of the surface area to be polished, the contact pressure, the abrasive particle size, the condition of the initial surface area to be polished, the properties of the glass type or material to be polished, etc.

In accordance with another aspect of the present invention, the machine base used is of a relatively substantial mass so as to aid in the reduction of energy loss over the entire system.

In accordance with another aspect of the present invention, the machine base used is of substantial mass so that the highest percentage of the total energy is transferred to the surface being processed.

In one embodiment of the process of this invention, it is important that efficiency be maintained so that all possible energy can be transferred from the apparatus through the tool and pad to the surface being processed.

In accordance with another aspect of the present invention, the backing used is of a compliant nature so as to allow for compliance of the overall form of the surface being processed.

In accordance with another aspect of the present invention, the abrasive covering is such that it will comply with the general form of the surface being processed yet maintain a surface tension that will allow for the signature mentioned prior, to be removed or minimized.

In accordance with another aspect of the present invention, the apparatus is designed so that the tool mount may accept a tool that will remove the problem as described above, not only in an annular fashion, but will accept a tool for localized blending over specific regions of. the surface being processed.

The abrasive article for use in the method of the invention may optionally include other abrasive particles in addition to cerium oxide. The optional abrasive particles can either be hard or soft inorganic abrasive particles or mixtures thereof. Examples of hard abrasive particles include aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, and the like.

In one embodiment, the abrasive used is comprised of at least about 50 weight percent of cerium oxide, by dry weight of all abrasive material used. It is preferred, in this embodiment, that the abrasive comprise at least about 80 weight percent of the cerium oxide.

In one embodiment, the abrasive is used in the form of a slurry that comprises abrasive material and liquid. One preferred liquid so used is water.

When water is used in the slurry, it is preferred that the slurry have pH of from about 4 to 11. In one embodiment, the pH is from about 4 to about 7. In another embodiment, the pH is from about 7 to about 11.

In one embodiment of the process of this invention, the temperature of the slurry is substantially constant during the grinding operation, varying generally by no more than about five degrees Fahrenheit over the coarse of each polishing cycle.

In general, the particle size distribution of the abrasive particles in the slurry ranges from about 0.05 to about 10 microns.

In one embodiment, the polishing slurry used has a specified Baume range. Baume relates to the specific gravity or the density of a solution. Means for measuring degrees Baume are well known. Reference may be had, e.g., to U.S. Pat. Nos. 6,357,351, 6,365,568, 6,050,283, 6,293,197 and the like. The entire disclosure of each of these United States patents is hereby incorporated by reference into this specification. In general, the preferred baume for the slurry range from about 1 to about 25 degrees Baume. In one embodiment the baume is from about 1 to about 10. In another embodiment the baume is from about 11 to about 15. In another embodiment the baume is from about 16 to about 25.

Figure 3A:
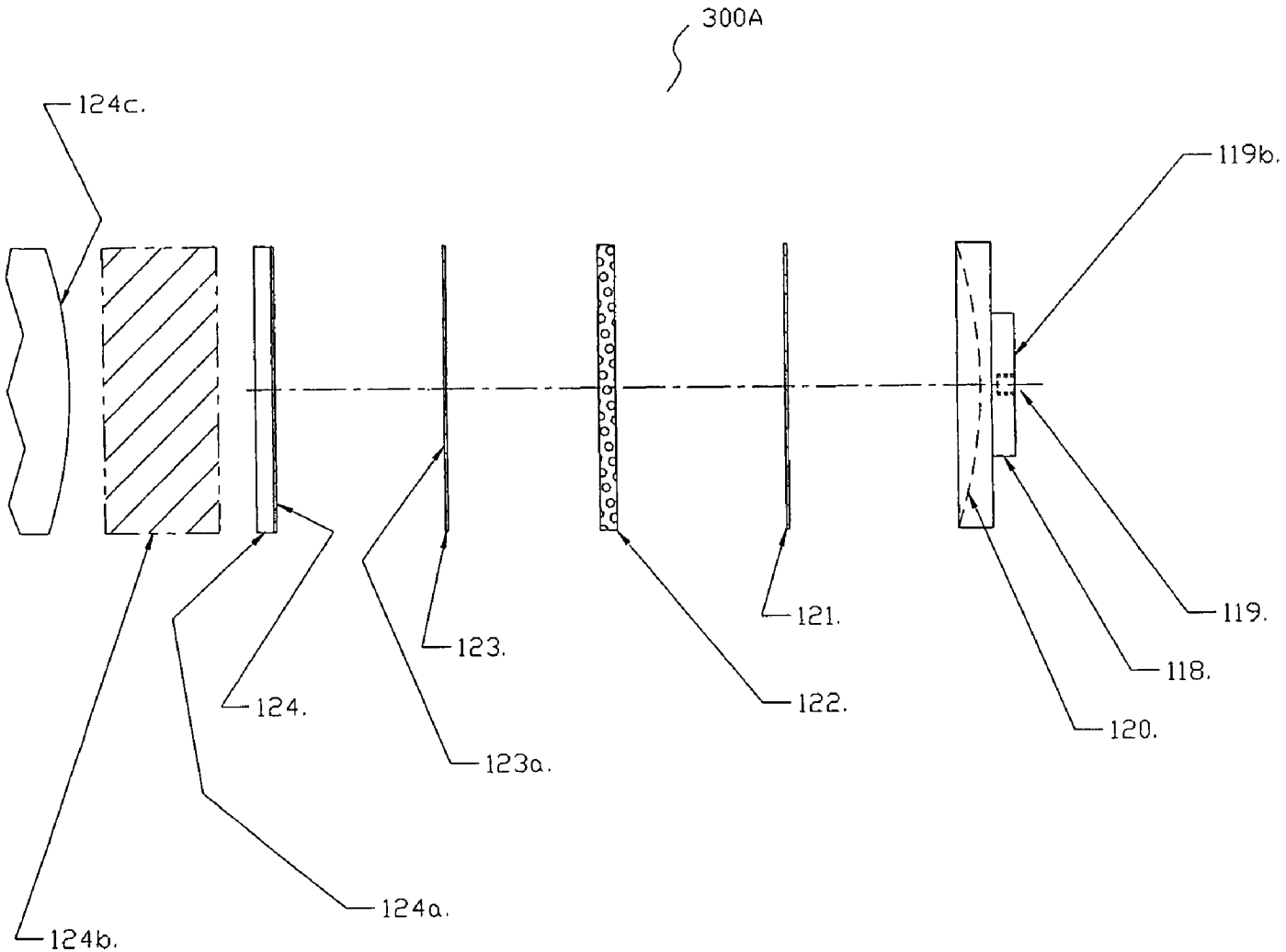
FIG. 3A is an exploded view of a tool that may be used with the machines depicted in FIGS. 1 and 2.

In accordance with another aspect of the present invention, illustrated in FIG. 3A, tool body 118 attached to the tool mount (FIGS. 4 and 5), is able to rotate free with rotation of the apparatuses upper spindle (FIGS. 6 and 7) or be locked against this free rotation, therefore varying the removal rate of material from the surface being processed. While the upper spindle is in rotation, the tool body may oscillate in the predescribed manner or oscillate and rotate with the rotation of the upper spindle.

In accordance with another aspect of the present invention, slurry is supplied to the pad and backing material by which it is preferred that the material remains in a constant state of saturation over the entire processing cycle.

In accordance with another aspect of the present invention, keeping the pad saturated with a polishing medium or slurry is preferred so that the surface of the pad will maintain a fresh cutting action along the interface between the pad and the surface being processed.

In accordance with another aspect of the present invention, the polishing medium will remain as a mist surrounding the pad and tool for the duration that the surface is being processed. For the purposes of this application, the term "mist," refers to a mass of fine droplets of slurry and or water. Reference may be had, e.g., to U.S. patent applications Nos. 20,010,007,809, 20,020,081,214, 20,020,074,674, 20,020,035,762, 20,020,023,973, and the like; the entire disclosure of these United States patent applications are hereby incorporated by reference into this specification.

In this specification applicant has disclosed several different inventions. One such invention relates to a technique of polishing a surface to be processed. Another such invention relates to a technique of removing signatures left on the surface being processed by previous grinding and polishing techniques. Yet another such invention relates to several polishing apparatuses and tools.

One invention disclosed in this application relates to tools that are cut specifically to each surface being processed. Another such invention relates to a smoothing method that blends previously left signatures on the surface being processed. Yet another such invention relates to a pad design composed of a compliant backing and an abrasive pad material that is treated in order that it will possess the correct surface tension for removing these signatures.

In one embodiment, the process of the present invention imparts a vibration, of from about 0.25–50 kHz, on the tool used in said processes.

In another embodiment, there is disclosed an apparatus with a component whose adjustable frequency and length of oscillation is transmitted to the tool.

In another embodiment, there is disclosed a polishing medium or slurry that saturates the polishing pad.

In another embodiment, there is disclosed a mechanical, ultrasonic motion to excite said polishing medium as well as the abrasive polishing pad.

The excited slurry preferably exists as a mist around the polishing pad, tool, and the surface being processed during the polishing cycle.

There is also disclosed a method of controlled and finite form adjustment on the surface being processed.

The present invention also relates to a method of uniform annular removal of material form that surface being processed.

The present invention may utilize a series of different ultrasonic oscillatory motions. These motions may include linear or eccentric oscillations.

In the first part of the remainder of this specification, specification, applicant's process will be described.

For purposes of the present invention, the term "polishing" means removing previous scratches to provide a fine, mirror-like finish without visually-identifiable scratches in the surface of the glass work piece. As another criteria of successful polishing in the method of the invention, the polished glass surface has an Rt value of from about 0.25 micrometers to about 2.5 micrometers as measured by a SURTRONIC 3 profilometer, available from Rank Taylor Hobson, Leicester, England, having a 500 micrometer radius tip. This surface finish is needed to ensure that the glass surface is free of wild swirls and deep scratches, which would impair the optical properties of the glass surface.

Examination of both surface quality and form is preferably done so using the Talysurf contact profilometer, by Rank Taylor Hobson. However, one may also use non-contact or optical profilometry in analyzing the surface being processed. Reference may be had, e.g., to U.S. Pat. Nos. 5,509,557, 6,140,551, 5,447,466,4,826,612 and the like. The entire disclosure of each of these United States patents is hereby incorporated by reference into this specification.

The term "midspatial," refers to a specific range of signature on the surface being processed. Denoted as a wave, said signature ranges from a wavelength of greater than 80 micrometers to less than 8000 micrometers. Classically, roughness with a wavelength less than 80 micrometers is considered microroughness. One object of the present invention is to minimize midspatial roughness.

The term "point contact," refers to the occurrence at which a tool or pad from a polishing body makes a very localized contact with the surface being processed. For example, a polishing machine used for correcting an aspheric form may have a tool that makes contact with the lens along a 0.5–5.0 rom band as the tool and the surface being processed are rotated in opposite directions as they come into contact. This would be considered a point contact because the relatively large load is focused on a very small portion of the surface being processed.

In general, the pad used in the process of this invention is preferably comprised of a backing material that consists essentially of foam. One such pad is illustrated in FIG. 3A. Reference may be had, e.g., to U.S. Pat. Nos. 5,525,179, 5,507,806, 5,319,007, 5,096,520 and the like. The entire disclosure of each of these United States patents is hereby incorporated by reference into this specification.

FIG. 3A is an exploded view of a tool/backing/pad assembly 300A. Referring to FIG. 3A, it will be seen that the tool/backing/pad. assembly 300A is comprised of tool body 118 disposed beneath a backing 122 which, in turn, is disposed beneath a pad 124. Also referring to FIG. 3A, it will be seen that there exists a layer of adhesive 121 between said tool body 118 and said backing 122. Also referring to FIG. 3A, it will be seen that there exists a layer of adhesive between said backing 122 and said pad 124.

In one embodiment, illustrated in FIG. 3A, the abrasive boundary 124*a* between the pad 124 and the surface being processed 124*c* may be a layer of coated abrasive 124*a*.

In one embodiment, illustrated in FIG. 3A, the pad 124 is comprised of a fabric coated with pitch. As is known to those skilled in the art, pitch is used in polishing and is derived from the heaviest fraction of the distillation of petroleum, also derived from tree sap. For fine polishing, it is preferred that the pitch used be derived from tree sap.

In one aspect of this embodiment, the pad 124 is comprised of from about 5 to about 50 weight percent of such pitch 124*a* on pad 124 (dashed line). It is more preferred to use from about 7 to about 40 weight percent of such pitch 124*a*. It is even more preferred to use from about 10 to about 20 weight percent of such pitch.

It is preferred that the pitch have a melting point of from about 38 to about 93 degrees Celsius. In one embodiment the melting point of the pitch is from about 38 to about 57 degrees Celsius. In another embodiment the melting point of the pitch is from about 58 to about 66 degrees Celsius. In another embodiment, the melting point of the pitch is from about 67 to about 93 degrees Celsius.

In one embodiment, such pitch on pad 124 is disposed contiguous with the layer of coated abrasive 124*a*; in such embodiment, the pitch layer is very thin (less than 0.5 millimeters).

In another embodiment, the pitch on pad 124 is incorporated into pad 124 and is preferably optical pitch. In one embodiment such optical pitch can be purchased through Universal Photonics Incorporated as, "Very soft optical pitch", product number PGO055.

Without wishing to be bound to any particular theory, applicant believes that soft optical pitch is preferred because of its tendency to flow when excited or heated. Pitch, while fairly solid, does become compliant as well when heated. Reference may be had, e.g., to U.S. Pat. No. 5,319,007; the entire disclosure of this United States patent is hereby incorporated by reference into this specification.

Referring again to FIG. 3A, and in one embodiment thereof, the boundary between the tool 118 and the surface being processed 124*c* may be a coated abrasive 124*a*. One may use coated abrasives known to those skilled in the art such as, e.g., abrasives containing abrasive particles such as cerium oxide and the like suspended in a compliant polymer. Compliance refers to the polymers uniform change in volume with respect to an applied load. For example, for a uniform loading of 10 pounds per square inch on such a polymer, the volume at each location of the material changes by the same amount. Since the length and width of the backing only vary by from about 1 percent to about 5 percent of their initial dimensions, after the load is applied, comparison from the applied loading to the change in thickness of the backing 122, illustrated in FIG. 3A, can be made. Therefore, uniform compliance of backing 122 implies that as the load of say 10 pounds per square inch is applied to the tool/backing/pad assembly 300A, backing 122 is compressed to a uniform thickness over the entire curve 120, also illustrated in FIG. 3A. Reference may be had, e.g., to U.S. Pat. Nos. 6,343,129, 6,263,566, 6,222,263, 6,181,149, and 6,097,087; the entire disclosure of these United States patents are hereby incorporated by reference into this specification.

In one embodiment, such compliant polymer may be epoxy, silicone, sol gel, and the like. Reference may be had, e.g., to U.S. Pat. Nos. 6,343,129, 5,641,818, 6,368,896, and 6,388,824; the entire disclosure of these United States patents are hereby incorporated by reference into this specification.

The compliant polymer comprises the pad 124, illustrated in FIG. 3A. One may use any of the pads 124 known to those skilled in the art. Reference may be had, e.g., to U.S. Pat. Nos. 6,343,129, 5,641,818, 6,368,896, 6,388,824; the entire disclosure of these United States patents are hereby incorporated by reference into this specification.

As used in this specification, the term "pad" refers to a structure 124, illustrated in FIG. 3A comprised of abrasive material that, while preferably saturated with a polishing medium, represented by abrasive 124*a*, makes contact with the surface being processed 124*c*, also illustrated in FIG. 3A.

In one embodiment, the pad 124 is comprised of said abrasive material and a support; in this embodiment, the abrasive material is embedded within the support, either prior to the polishing or during the polishing.

One may use pads 124 comprised of supports that comprise or consist essentially of a polymeric material. The polymeric material may be fibrous, may be film-like, and/or may exist in other forms.

One preferred type of pad 124, referring to FIG. 3A, is comprised of polymeric woven or nonwoven fabric. Regardless of the physical state the polymeric material is in, it is preferred to use polymeric material such as, e.g., polyester, polyester and co-polyester, microvoided polyester, polyamide (nylon), polyvinyl alcohol, polypropylene film, polyethylene film and the like. Referring to FIG. 3A, pad 124 is comprised of a woven wool cloth, approximately 0.5 to 1.0 millimeters in thickness. In one embodiment, illustrated in FIG. 3A, the preferred pad has characteristics of being durable meaning that it will remain on the tool as originally constructed for more than 25 cycles, as well as absorbent. The term absorbent refers to the characteristic of holding some amount of abrasive in the matrix of the material to be released during the polishing cycle.

In one embodiment, illustrated in FIG. 3A, pad 124 may be purchased from Universal Photonics Incorporated, as "Blue streak wool pads," product number FN series.

In one embodiment, and referring to FIG. 3A, there should also be good adhesion between the polymeric backing 122 and the pad 124. There should also be good adhesion between backing 122 and tool body 118. For good adhesion, two properties are desired from the adhesive layers 121, and 123 respectively. As backing 122 compresses to approximately 50% of its initial thickness during the polishing cycle, backing 122 should not become detached from tool body 118. In the same respect, also referring to FIG. 3A, pad 124 should not become detached from backing 122 during the polishing cycle. The second property desired of adhesive layers 121, and 123 relate to durability. Pad 124 should not become detached from backing 122 over no less than 50 cycles. In the same respect, backing 122 should not become detached from tool body 118 over no less than 50 polishing cycles. The number of preferred cycles relating to durability may vary as a function of average cycle time.

In one embodiment, also illustrated in FIG. 3A, the pad is integrally connected to the abrasive. Not only do the abrasive particles 124*a* exist on the top of pad 124, but said abrasive particles exist in the pad 124 and backing 122 as well.

Figure 3B:
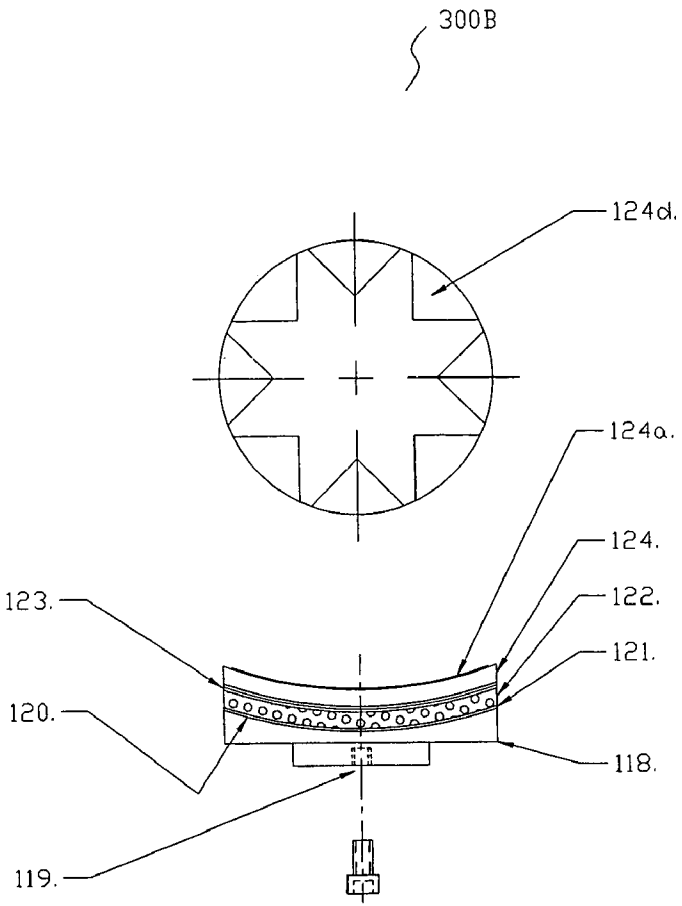
FIG. 3B is a top and side view of a tool that may be used with the machines depicted is FIGS. 1 and 2.

In one preferred embodiment, and referring to FIG. 3A, the abrasive layer is not only composed of the pad 124 and abrasive particles 124*a*, but a thin layer of pitch as well. After tool/backing/pad assembly 300A is complete as shown in FIG. 3A, a layer of pitch may be added to the surface of said pad 124 by heating the pitch as well as the pad and applying the heated pitch with a small flat metal spatula. The assembled tool/backing/pad assembly thus far is illustrated in FIG. 3B as tool/backing/pad assembly 300B. In this embodiment, it is preferred that the layer of pitch be as uniform as possible in order to ensure uniform removal and prevent scratches. Reference may be had, e.g., to U.S. Pat. Nos. 5,525,179, 5,507,806, 5,319,007, 5,096,520 and the like. The entire disclosure of each of these United States patents is hereby incorporated by reference into this specification.

Figure 3C:
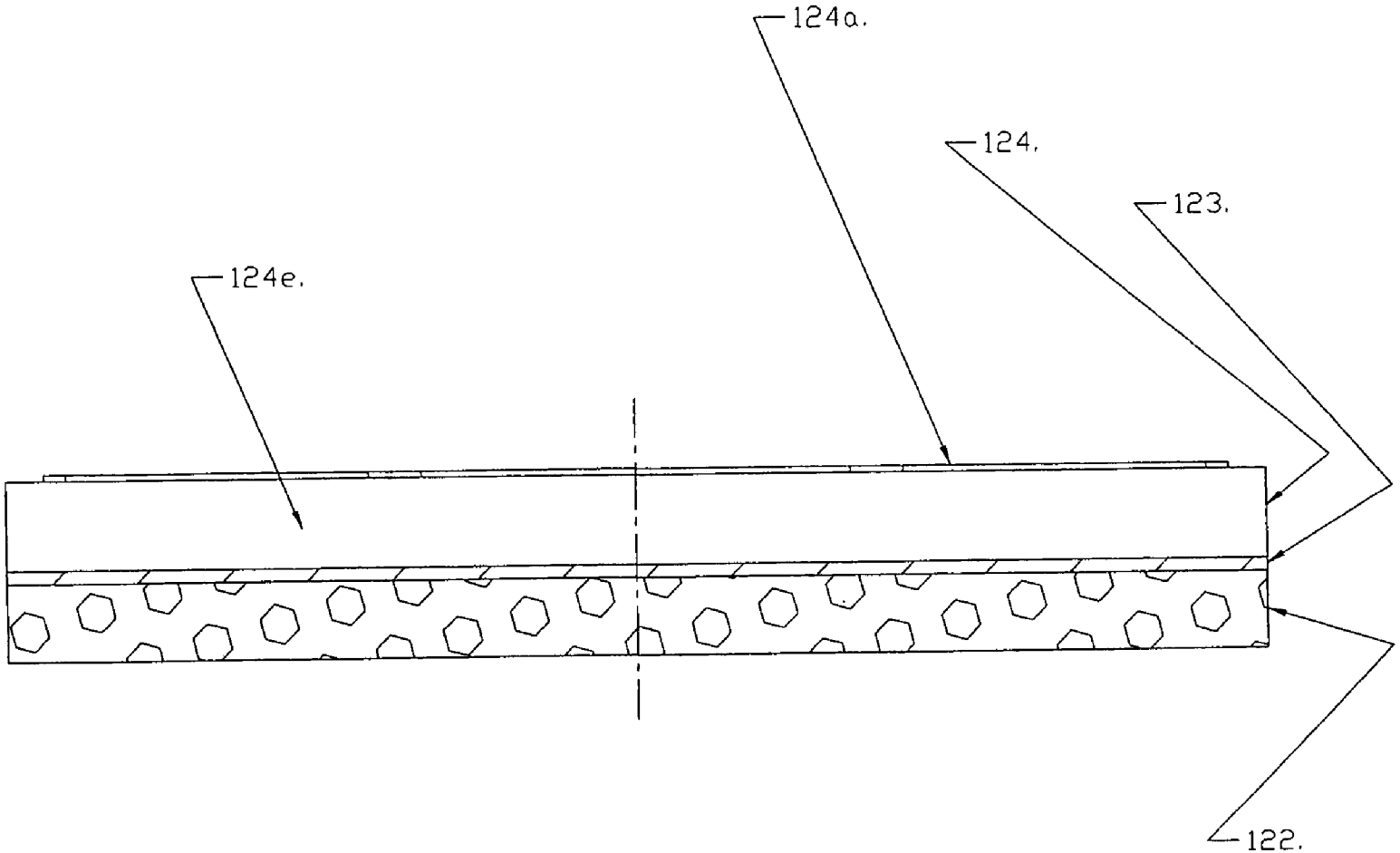
FIG. 3C is sectional view of one embodiment of the materials covering the tool depicted in FIGS. 3A and 3B.

In another embodiment, illustrated in FIG. 3C, the pad, backing, abrasive, and adhesive layers may exist as one embodiment. In addition to methods of creating pad 124, backing 122, abrasive layer 124*a*, and adhesive layer 123 discussed elsewhere in this document, one may produce the structure of pad 124, backing 122, abrasive layer 124*a*, and adhesive layer 123 illustrated in FIG. 3C by preparing a mixture of A and B in a ratio of C/D, charging it to a container (not shown), mixing for from about 1 to about 20 minutes, and then disposing said mixture in a mold wherein after it is cured (not shown), it will form the desired pad impregnated with abrasive. Applying the right mixture of epoxy to a container and then thoroughly mixing in an abrasive particle such as cerium oxide and the like, the mixture could then be poured into a mold.

In another embodiment, when the pad of the process of this invention is compressed with a force of from about 1 to about 15 pounds per square inch, and the pad is compressed to a width of from about 0 to about 50 percent of its uncompressed state, the force required to compress such pad to any width within such range is substantially constant, varying by less than about 10 percent.

Referring again to FIG. 3A, and in the preferred embodiment depicted therein, backing 122 is disposed between a first adhesive layer 121 and a second adhesive layer 123. As used in this specification, the term "backing," refers to a compliant material that lies between the polishing pad and the tool body itself. The term "compliance," refers to a property given to rubber and foam materials and indicates the change in volume of a material after a given load is applied. To say that a material is compliant indicates that that change in volume is uniform with respect to that applied load. For example, for a uniform loading of 10 pounds per square inch, the volume at each location of backing 122 along surface 120, illustrated in FIG. 3A changes by the same amount. Since the length and width of the backing may only vary by 1% of there initial dimensions, after the load is applied, comparison from the applied loading to the change in thickness of the backing 122, illustrated in FIG. 3A can be made. Therefore, uniform compliance of backing 122 implies that as the load of say 10 pounds per square inch is applied to tool/backing/pad assembly 300A, backing 122 is compressed to a uniform thickness over the entire curve 120, also illustrated in FIG. 3A. Reference may be had, e.g., to U.S. Pat. Nos. 6,343,129,6,263,566,5,769,882,5,641,818, 4,791,275, 4,227,111, and the like; the entire disclosure of these United States patents are hereby incorporated by reference into this specification.

During the polishing operation, the surface being processed 124*c* illustrated in FIG. 3A, comes in contact with the polishing pad 124, which is preferable to return a relatively uniform force because of the nature of the backing itself.

One preferred type of backing is comprised essentially of neoprene; such backing is generally in the shape of the tool 118 that it will be contiguous with. Neoprene rubber is made from a Polychloroprene synthetic polymer. Its specific ingredients are as follows. Less than 1% talc by weight, greater than 98% 2-chloro-1,3-butadiene polymers & copolymers by weight, and less than 1% water by weight.

In one embodiment, the backing 122, illustrated in FIG. 3A, is comprised of an open or closed cell configuration depending on desired effects and the material being processed.

Other backing materials may include an array of self adhesive polyurethane and vinyl foams. Another type of preferred backing is silicone. Specifically this may include Dow Corning 165 AIB Silicone Elastomer. Said silicone elastomer has a specific gravity of 1.57, is gray in color, and is a two part mixture. It's room temperature cure time is approximately 5 minutes. In one preferred embodiment, backing 122, as shown in FIG. 3A, is composed of an open—cell neoprene. Preferred characteristics of said backing include its durability, or its resistance to wear over time, as well as its relatively uniform compliance. Its compliance refers to its ability to return a uniform load over a range of deflections. The material used as backing must be compliant and durable to both form to the surface being processed and to resist wear in an abrasive environment respectively.

Various types of backings may be used in order to obtain the proper level of compliance and durability including neoprene, gum rubber, vinyl foam, polyvinyl chloride foam, urethane foam, and silicone rubber. Reference may be had, e.g., to U.S. Pat. Nos. 6,267,743, 6,247,811, 6,235,661, 6,042,604, 6,227,262 and the like. The entire disclosure of each of these United States patents is hereby incorporated by reference into this specification.

In one preferred embodiment, illustrated in FIG. 3A, compliance of the backing is achieved by using an open—cell neoprene rubber. In this embodiment, such material is sold by the Chamberlain Rubber Co. of Rochester, N.Y., as product number SCE41 b.

The term "adhesive" applies, as illustrated in FIG. 3A (see elements 121 and 123), to a layer of material that attaches the surrounding layers to it. In one embodiment, illustrated in FIG. 3A, the backing 122 has an attachment means 123 on its top surface 123A to secure the resulting pad 124 and/or coated abrasive 124*a*. This attachment means 123 can be a pressure sensitive adhesive (PSA) or tape, a loop fabric for a hook and loop attachment, or an intermeshing attachment system.

Referring again to FIG. 3A, it will be seen that adhesive layer 123 is disposed between pad 124 and backing 122. It will also be seen that adhesive layer 121 is disposed between backing 122 and tool body 118. Thus, as will be apparent, the backing 122 with its accompanying adhesive layers 121 and 123 is self-adhesive. These type of self-adhesive materials are well known to those skilled in the art of manufacturing optics.

In one embodiment, Referring again to FIG. 3A, the chosen backing 122 does not posses the ability for self-adhesion; in this embodiment, additional adhesives are added to the backing. This adhesive may be, e.g., 2-Propenoic Acid, 2-cyano, ethyl ester; to form ethyl cyanoacrylate. By way of further illustration, other adhesives may include polyvinyl acetate, ethylorthosilicate, or a variety of resins.

In one preferred embodiment, illustrated in FIG. 3A, the attaching means used is double sided adhesive tape. In one embodiment, such double-sided adhesive tape is sold by the 3M company as "Polyester Film Tape," product number 70-0060-0708-5. This adhesive tape is comprised of a thin polyester film coated with an acrylic adhesive. Reference may be had, e.g., to U.S. Pat. Nos. 4,846,744, 4,619,055, and the like. The entire disclosure of each of these United States patents is hereby incorporated by reference into this specification.

Referring again to FIG. 3A, tool body 118 is a machined tool whose top surface 120 has a profile or curve cut to it. The purpose of the tool body 118 is to support backing 122 and pad 124 as well as to provide a limit for some maximum deflection of the backing material by means of its contour. The bottom surface 119*b* has a 6–32 tap 119 drilled into it for mounting it to the drive shaft 104 (illustrated in FIG. 4). Contour 120, illustrated in FIG. 3A, is depicted by the size and contour of the surface being processed as well as its desired effects. In one embodiment, also illustrated in FIG. 3A, 3 millimeters is added to the best fit radius of the surface being processed 124*c*, which then equals the curve cut 120 to the tool body 118. The addition of 3 millimeters derivatives from the approximate added thicknesses of the adhesive layers 121, and 123, as well as pad 124 and the compressed thickness of backing 122. The pad 124 and baking 122 are attached to the tool body 118 to form a contoured surface with which to polish the surface being processed.

Referring again to FIG. 3A, tool body 118 is preferably cut with curve 120 on its front surface.

Figure 4:
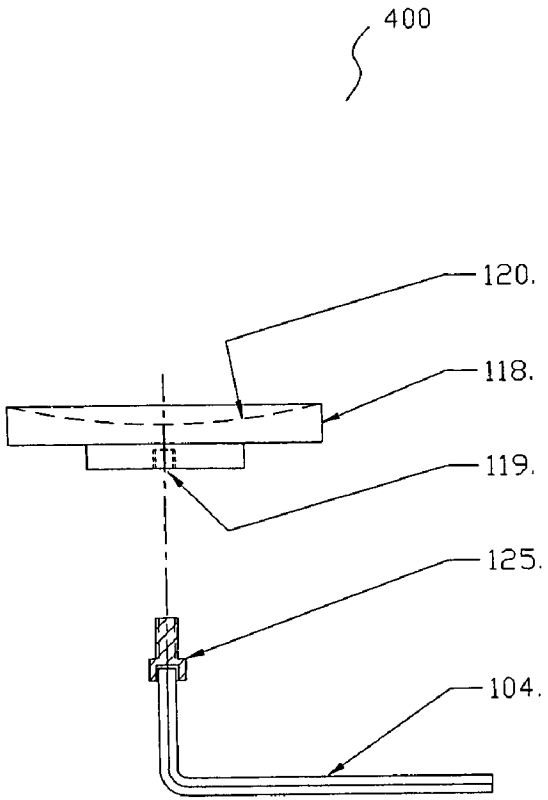
FIG. 4 is a schematic view of one preferred tool mount assembly.

Attached to tool body 118 is an adhesive layer 121, also illustrated in FIG. 3A. In one embodiment, also illustrated in FIG. 3A, 6–32 tap 119 is drilled into tool body 118. This is done so that 6–32 Allen head cap screw can be inserted into the tap. This fixture is shown in FIG. 4.

Referring again to FIG. 3A, various materials may be used for said tool body including steel, stainless steel, aluminum, titanium, composite materials and the like. Exact dimensions for said tool body are dictated by the surface being processed. For example, in many cases a best fit radius of the surface being processed will be cut onto surface 120, with additional compensation for the thickness of pad 124, backing 122, and adhesive layers 121, and 123. For complex geometries, where the surface being processed has both concave and convex surfaces, the curve is approximated on a computer aided design software package so that the approximate curve 120 can be cut to tool body 118, illustrated in FIG. 3A.

In one preferred embodiment, as illustrated in FIG. 3A, the outside diameter of tool body 118 is 50 millimeters. The diameter of bottom surface 119*b* of tool body 118 in which 6–32 tap 119 is drilled is 25 millimeters. The total height of tool body 118 is 10 millimeters, 6 millimeters, and 4 millimeters, for the top and bottom sections respectively.

In one preferred embodiment, and referring again to FIG. 3A, 6061 aluminum is used as a material for said tool body. This material is advantageously used because it is resistant to corrosion, lightweight, and inexpensive to replace. In one embodiment, such aluminum is sold by the Admiral Metals Co. as "6061-Aluminum." Reference may be had, e.g., to U.S. Pat. Nos. 6,364,135, 6,318,932, 5,161,728, 5,131,957 and the like. The entire disclosure of each of these United States patents is hereby incorporated by reference into this specification.

The preferred embodiment illustrated in FIG. 3A, is assembled as follows. A basic corn syrup is preferably spread over the surface being processed in a very thin layer. While the syrup dries, pad 124 and backing 122 are cut out to a desired size and shape. In one preferred embodiment, the pad and backing are cut into circular shapes that are large enough to cover the surface of tool body 118. Small triangular or elliptical notches are then cut around the outside of pad 124 and/or backing 122 so they will more easily form to the tool body and so that the material will be more uniformly removed from the surface being processed 124*c*. This is because that, if no material was removed from the edge of pad 124, more material would be removed from the edge of the surface being processed 124*c* because of the relative rotation is greater at the edge of the surface being processed 124*c* than at the center of the surface being processed 124*c*. Backing 122 is adhered to pad 124 via adhesive layer 123 and the pad and backing are then applied to the surface being processed. The pad and backing is pressed into the syrup so that pad 124 sticks to the surface being processed. Adhesive layer 121, which may be ethyl cyanoacrylate, is then applied to the surface of the tool body. Tool body 118 is then placed on the top of the pad/backing which is atop the surface being processed 124*c* (illustrated in FIG. 3A). Correct placement of the tool body onto the pad/backing is essential so the assembly may be done so using an alignment system, milling machine or press. The adhesive is allowed to dry for approximately 10 minutes. After the assembly is allowed to dry, it is submerged in water, approximately at room temperature, allowing the syrup to dissolve. The assembly will then separate leaving the tool/backing/pad assembly 300A apart from the surface being processed. This finished assembly is also shown in FIG. 3B as tool/backing/pad assembly 300B.

Referring again to FIG. 3A, depending on the desired frequency and amplitude of signature that needs to be removed, different pads 124 may be used, or a very thin layer of soft optical pitch 124*a* (illustrated in FIG. 3A) may be added to the surface of the pad. This will increase the surface tension of the pad and therefore remove larger peaks from the surface being processed.

Referring to FIG. 4, it will be seen that a preferred embodiment for use with the preferred embodiment, illustrated in FIG. 1 is tool mount assembly 400 shown therein. Said tool mount assembly for use with the apparatus shown in FIG. 1 is comprised of allen head cap screw 125 which sets atop drive shaft 104 and also screws into tap 119 of tool body 118.

In one embodiment said tool mount assembly illustrated in FIG. 4 is fixed to drive shaft 104. The purpose of said drive shaft 104 is to transmit linear mechanical oscillation to tool body 118 as well as to provide a resting place for allen head cap screw 125 with the embodiment of the tool mount assembly, also illustrated in FIG. 4.

One embodiment illustrated in FIG. 4, shown as drive shaft 104, has characteristics that include being inexpensive to replace, able to be bent when heated to temperature over 300 degrees Celsius, for approximately 1 minute, and durable (able to endure more than 50 cycles before material becomes cracked, fractured, or reaches plastic deformation). In another embodiment, materials for said drive shaft may include steel, aluminum, graphite, titanium, or composite and the like.

Referring again to FIG. 4, drive shaft 104 is comprised of a 7⁄64 allen blade. Said blade is preferably made of a high grade tool steel. In one preferred embodiment said blade may be purchased through the McMaster Carr Supply Co. as "ball point hex keys," product number 6972A17. Reference may be had, e.g., to U.S. Pat. Nos. 6,318,932, 5,161,728, 5,131,957 and the like. The entire disclosure of each of these United States patents is hereby incorporated by reference into this specification.

In one embodiment, illustrated in FIG. 4, the gimbal 125 sets above drive shaft 104. In this embodiment, the purpose of gimbal 125 is to provide partial rotation about the x and y axis so that tool body 118, also illustrated in FIG. 4, may oscillate about the axis with some freedom. In another embodiment, the gimbal 125 is drilled out to allow for free rotation about the z-axis so that tool body 118 may rotate freely with the system.

One preferred embodiment, illustrated in FIG. 4 as gimbal 125 has characteristics of being inexpensive to replace, easy to modify, and resistant to corrosion (able to endure at least 50 cycles).

In another embodiment, materials for gimbal 125 preferably include steel, stainless steel, aluminum, titanium, composite and the like. In one preferred embodiment gimbal 125 is made of stainless steel. In one embodiment said gimbal may be purchased through McMaster Carr Supply Co. as "6–32 Socket Head Cap Screw," product number 92196A139. Reference may be had, e.g., to U.S. Pat. Nos. 6,364,135, 6,318,932, 5,161,728, 5,131,957 and the like. The entire disclosure of each of these United States patents is hereby incorporated by reference into this specification.

Tool body 118, illustrated in FIG. 4, has been discussed in detail in the section of this specification that describes FIG. 3A.

In one embodiment, the assembly of FIG. 4 is assembled as follows. Drive shaft 104 is purchased as a straight shaft so in order for it to be as shown in FIG. 4, a 90-degree bend must be made in the shaft. Drive shaft 104 is heated where the desired bend is to take place using an oxygen torch. The 20 millimeter end of the allen blade, as illustrated in FIG. 4, is placed in a vice and bent so that a bend of 90 degrees exits between the 20 millimeter segment and the 50 millimeter segment of the allen blade. After the allen blade has been heated and bent, it is placed in room temperature water so at to resist cyclic loading during the polishing step 1018 (illustrated in FIG. 10A).

Gimbal 125, as illustrated in FIG. 4, preferably is a 6–32 allen head cap screw that has had the head drilled out to allow for the gimbaled action described hereinabove. Several combinations of gimbal 125, illustrated in FIG. 4 may be desired for each operation so that correct oscillation can occur.

Gimbal 125 preferably is screwed into tap 119 of tool body 118. Gimbal 125 is then allowed to rest on drive shaft 104. When linear drive unit 106 (illustrated in FIG. 1) is activated, drive shaft 104 will oscillate, causing tool body 118 to oscillate via gimbal 125.

Figure 2:
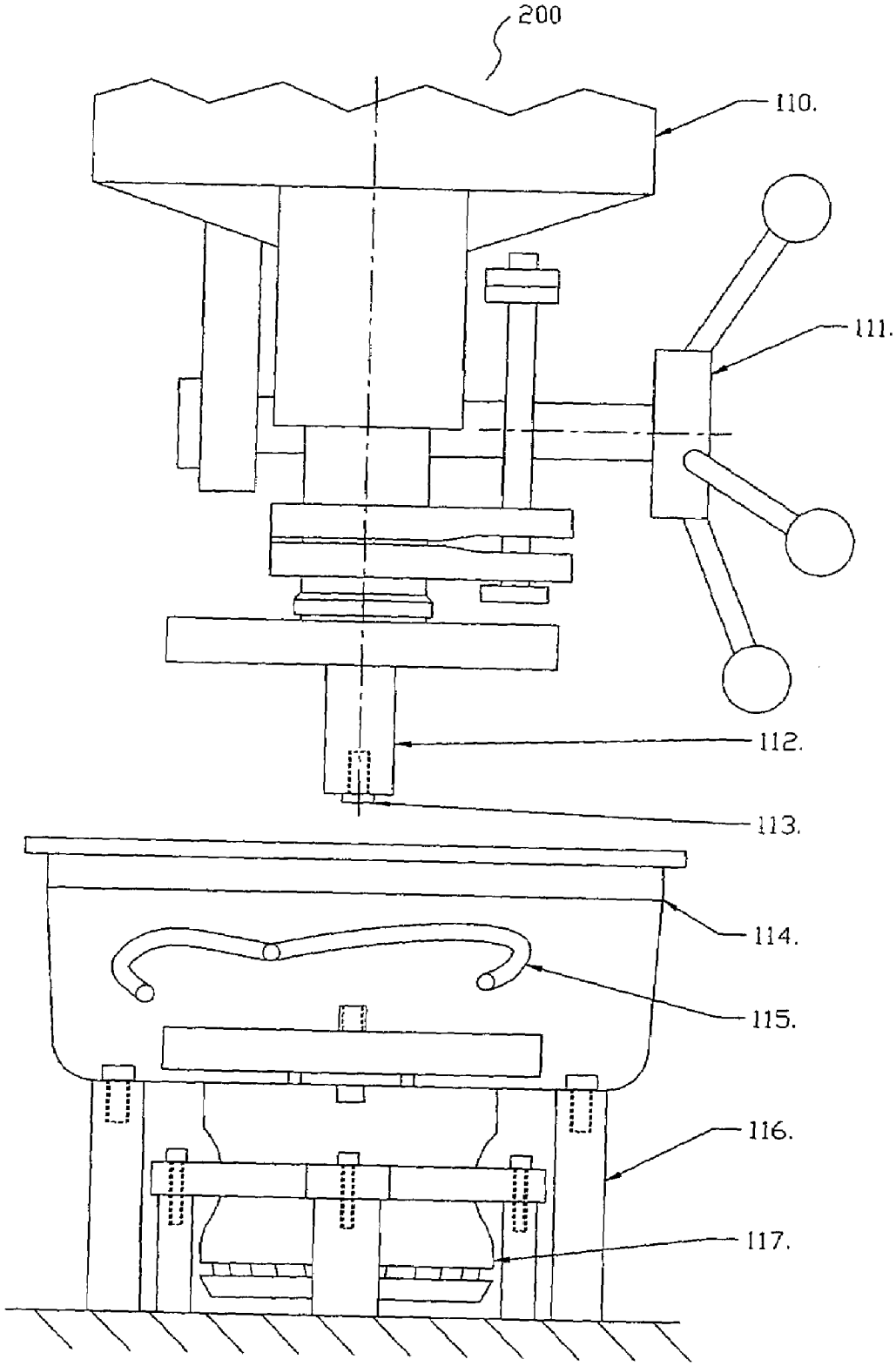
FIG. 2 is a schematic view of another preferred polishing machine.
Figure 5:
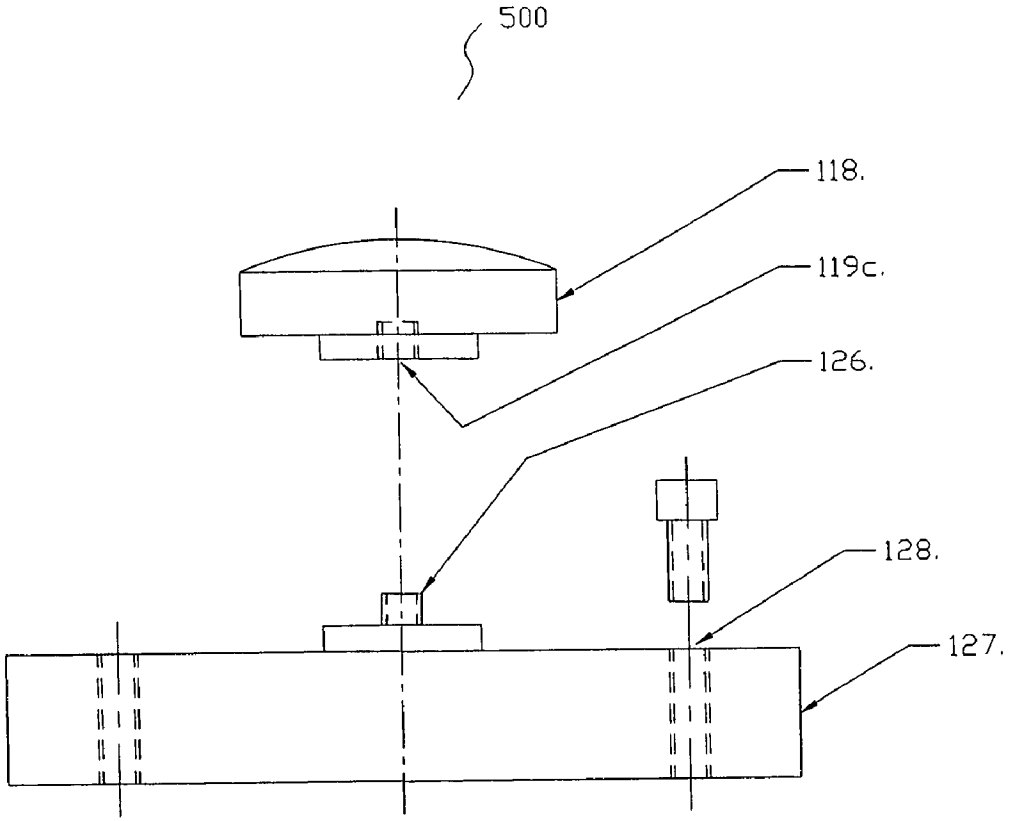
FIG. 5 is a schematic view of another preferred tool mount assembly.

Referring to FIG. 5, it will be seen that a tool mount assembly 500 is illustrated therein. This tool mount assembly 500 may be used with the linear drive unit 106 of FIG. 1. It will be seen that one preferred embodiment for use with another preferred embodiment illustrated in FIG. 2 is the tool mount 500 assembly shown there. The purpose of said tool mount assembly 500 is to allow tool body 118 to be attached to the preferred apparatus (see FIG. 2). In one embodiment, the tool mount assembly 500, illustrated in FIG. 5 is comprised of oscillating platform 127, and headless set screw 126.

In one embodiment, illustrated in FIG. 5, oscillating platform 127 is attached above the eccentric drive unit 117, illustrated in FIG. 2, through 4¼–20 tap holes 128. The purpose of the platform 127 is to provide support for tool body 118 by distributing the load on it through the allen head cap screws that go in the four tap holes 128, also illustrated in FIG. 5. Another purpose of oscillating platform 127 is to transfer the eccentric oscillatory motion of drive unit 117, illustrated in FIG. 2, to tool body 118, illustrated in FIG. 5.

One tool mount assembly 500, illustrated in FIG. 5, having such characteristics as oscillating platform 127, is preferably made of aluminum, steel, stainless steel, titanium, or composite materials and the like. In one preferred embodiment, said platform 127 may be made of 6061 aluminum. In one embodiment such aluminum is sold by the Admiral Metals Co. as "6061-Aluminum." Reference may be had, e.g., to U.S. Pat. Nos. 6,364,135, 6,318,932, 5,161,728, 5,131,957 and the like. The entire disclosure of each of these United States patents is hereby incorporated by reference into this specification.

Referring again to FIG. 5, in one embodiment, set screw 126 is set into the center of oscillating platform 127. Its purpose is to fix tool body 118 to oscillating platform 127, also illustrated in FIG. 5.

In one embodiment, illustrated in FIG. 5, some preferred characteristics of said set screw are its durability (more than 500 cycles to replacement), low cost, light weight, etc. In one embodiment, materials for said set screw include, e.g., aluminum, steel, stainless steel, titanium, composite materials and the like.

In one embodiment said set screw 126 is made of stainless steel. In another embodiment, said set screw is purchased From the McMaster Carr Supply Co. of New Brunswick, N.J. as "¼–20 Headless Socket Set Screw," product number 94355A535.

One preferred embodiment, illustrated in FIG. 5 illustrates how tool body 118 may be mounted to oscillating platform 127. In this embodiment, tool body 118 is fastened to oscillating platform 127 by screwing tool body 118 onto set screw 126. Tool body 118 preferably should be fastened until it's bottom surface is flush with oscillating platform 127. After tool body 118 is fastened to oscillating platform 127, a lens may be mounted into the upper spindle of the preferred apparatus.

Tool body 118 is preferably fastened tightly so that no asymmetry will be caused to the surface being processed because of a tool body whose centerline is not perpendicular to the center of the surface being processed. In one embodiment oscillating platform 127 has dimensions of 125 mm in diameter and 20 mm in height. Dimensions for tool body 118 are discussed earlier in this document. Oscillating platform 127 also preferably has 4¼–20 tapped holes in order to fit it to the eccentric drive unit.

When the surface being processed 124*c* is lowered onto the tool/backing/pad assembly 300A (illustrated in FIG. 3A), the oscillating motion from platform 127 (illustrated in FIG. 5) is transferred to tool body 118, thus removing material from the surface being processed.

Figure 6:
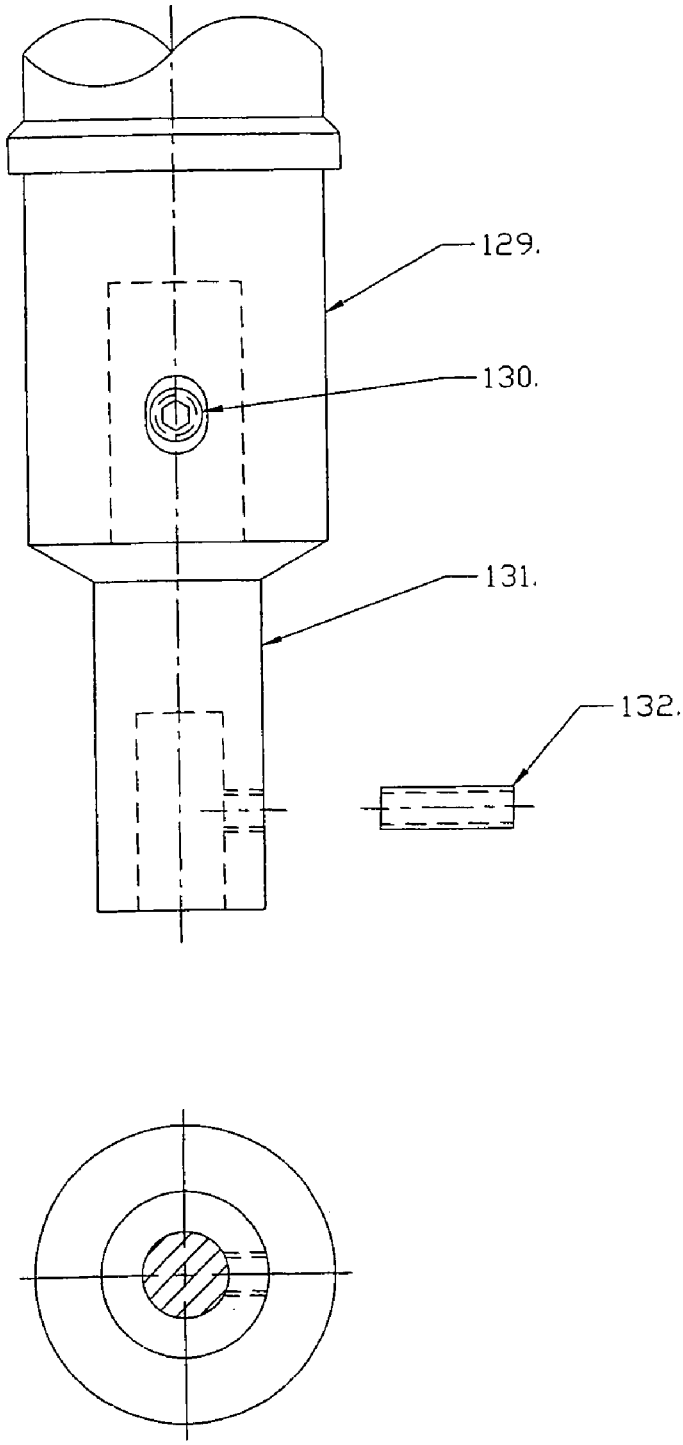
FIG. 6 is an end and side view, respectively, of one upper spindle of the apparatus of FIG. 1.

Referring to FIG. 6, it will be seen that upper spindle 600 is depicted therein. Referring to FIG. 6, it will be seen that one embodiment for use with the present invention will be comprised of spindle adapter chuck 129, set screw 130, spindle adapter 131, and set screw 132.

In one embodiment, illustrated in FIG. 6, spindle adapter chuck 129 is attached to the upper spindle of one preferred embodiment labeled as apparatus 100, illustrated in FIG. 1. The purpose of spindle adapter chuck 129 is to provide a means of attachment for spindle adapter 131 to the upper spindle of one preferred embodiment illustrated in FIG. 1 as apparatus 100.

In one embodiment, characteristics of said adapter 129 would include resisting wear from torsion occurring at upper and lower sections. In another embodiment materials for adapter 129 may include a variety of steels including cast, stainless, or any hardened steels and the like.

In one embodiment, Spindle chuck adapter 129 may be made of hardened steel. In another embodiment said adapter may be purchased from Dynaphth Systems Incorporated as a "½ inch tapered C-40 tool holder."

In one embodiment, illustrated in FIG. 6, spindle adapter 131 is attached to spindle chuck adapter 129 via set screw 130. The purpose of spindle adapter 131 is to provide a means for mounting a substrate. Typically, said substrate may be mounted on a body containing a ½-inch mounting post. Said post may be mounted into spindle adapter 131 via set screw 132.

In one embodiment, illustrated in FIG. 6, preferred characteristics of spindle adapter 131 would include, inexpensive to replace, having a loose enough tolerance of the bottom hole so that variations in posts for mount a substrate will not be a problem and the like. Materials for said adapter would include aluminum, stainless steel, composite materials and the like.

In one embodiment, illustrated in FIG. 6, spindle adapter 131 may be made of 6061 aluminum. In another embodiment, material for said adapter may be purchased through the Admiral Metals Co. as "6061-Aluminum." Reference may be had, e.g., to U.S. Pat. Nos. 6,364,135, 6,318,932, 5,161,728,5,131,957 and the like. The entire disclosure of each of these United States patents is hereby incorporated by reference into this specification.

In one preferred embodiment, illustrated in FIG. 6, spindle adapter chuck 129 is mounted into the upper spindle of one embodiment, illustrated in FIG. 1 as apparatus 100. Spindle adapter 131 is mounted into spindle chuck adapter 129 via set screw 130. Set screw 130 is made of a hardened steel and was and is specific to spindle chuck adapter 129. The substrate (mounted onto its mounting body) can be inserted into the end of spindle adapter 131 and secured in place via set screw 132. Because of the tendency for a mounting body to twist inside of the spindle adapter, set screw 132 may be made of Teflon, or polymer type material so as not to wear the mounting body of the substrate. After the substrate has been mounted into spindle adapter 131, the upper spindle may be lowered onto the tool/backing/pad assembly at the desired z location.

Figure 7:
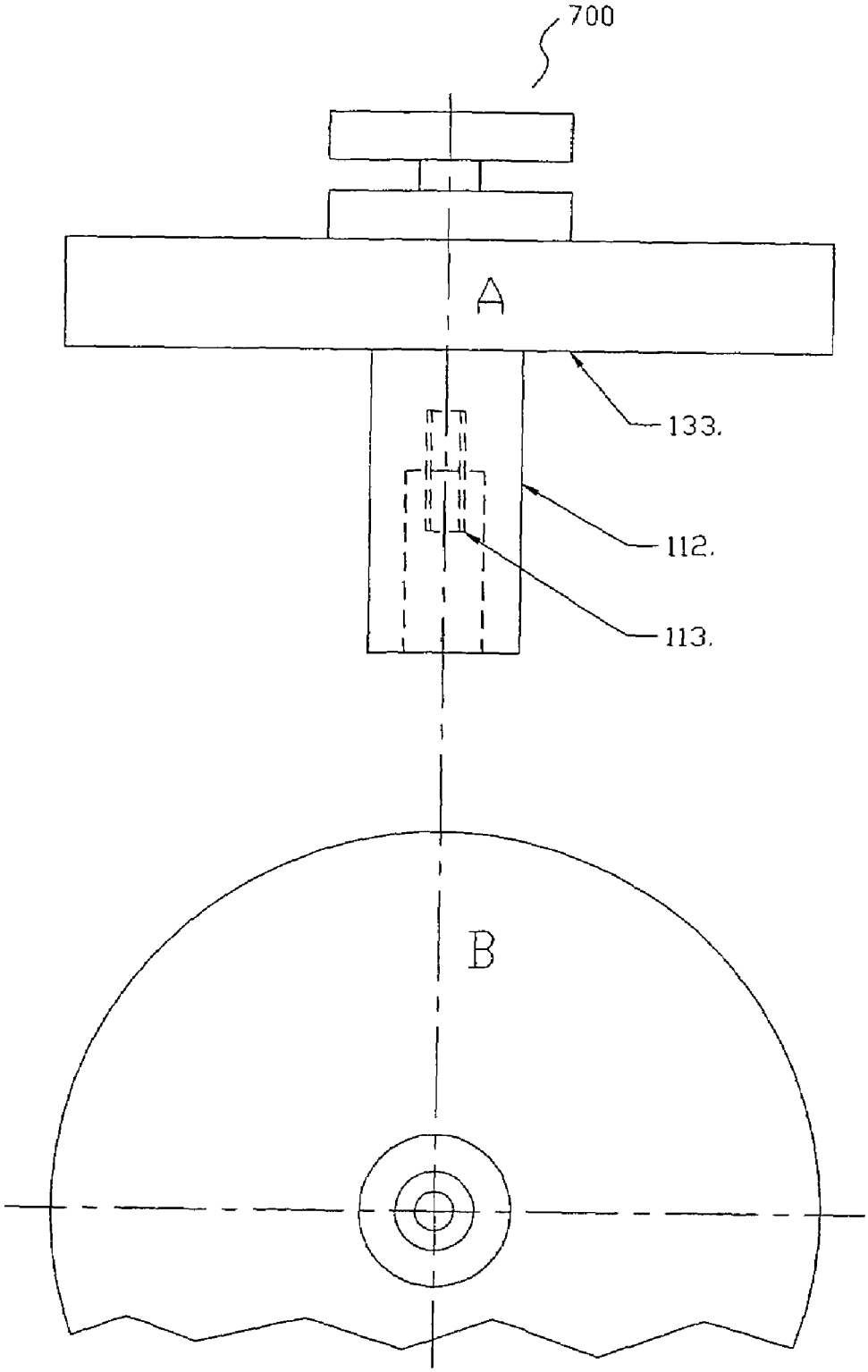
FIG. 7 is an end and side view respectively, of another upper spindle of the apparatus of FIG. 2.

Referring to FIG. 7, it will be seen that upper spindle 700 is depicted therein. It will be seen that one embodiment for use with the present invention will be comprised of upper spindle 112, and upper spindle mount 113.

In one embodiment, illustrated in FIG. 7, upper spindle 112 may be used with another embodiment illustrated in FIG. 2 as apparatus 200. The purpose of upper spindle 112 is to provide a means for fixing a substrate to another embodiment illustrated in FIG. 2 as apparatus 200. The function of upper spindle 112 may be similar in function to another embodiment, illustrated in FIG. 6 as spindle adapter 131 for use with another embodiment illustrated in FIG. 1 as apparatus 100.

In another embodiment, illustrated in FIG. 7, characteristics of said upper spindle include resistance to wear, and having tolerances that allow slight variation in diameter of a ½ inch post, of which a substrate is mounted to and the like. Materials of said spindle may include aluminum, stainless steel, composite materials and the like.

In one embodiment, illustrated in FIG. 7, upper spindle 112 is made of 6061 aluminum. In another embodiment material for said spindle may be purchased through the Admiral Metals Co. as "6061-Aluminum." Reference may be had, e.g., to U.S. Pat. Nos. 6,364,135, 6,318,932, 5,161, 728, 5,131,957 and the like. The entire disclosure of each of these United States patents is hereby incorporated by reference into this. In one embodiment, illustrated in FIG. 7, upper spindle mount 113 fastens into a tapped hole within upper spindle 112, also illustrated in FIG. 7. The purpose of spindle mount 113 is to provide means of attachment for a substrate to the upper spindle. In one embodiment, illustrated in FIG. 7, characteristics of spindle mount 113 include being easily and inexpensively replaceable. Materials for said mount may include aluminum or high grade tool steel.

In one embodiment, upper spindle mount 113 may be made of steel, or aluminum. In another embodiment upper spindle mount 113 may be purchased through McMaster Carr Supply Co. as "¼–20 Headless Socket Set Screw," product number 94355A535.

One embodiment, illustrated in FIG. 7, may be used for another embodiment illustrated in FIG. 2 as apparatus 200. The upper spindle, illustrated in FIG. 7 may serve a similar function as one embodiment illustrated in FIG. 6. The purpose of the upper spindle is to provide attachment means of the substrate as well as to provide rotational motion to it via the upper spindle drive unit. For the purpose of this application upper spindle drive unit is discussed later in this application. A substrate is mounted into the spindle of one embodiment, illustrated in FIG. 7 by means of upper spindle mount 113.

Referring to FIG. 1, it will be seen that apparatus 100 is depicted therein. Referring to FIG. 1, it will be seen that one preferred apparatus for use with the present invention will be comprised of upper spindle drive unit 109, upper spindle 101, x and y axis control 108, and z axis control 100.

Items 100, 101, 102, 108, and 109 illustrated in FIG. 1 are part of one preferred embodiment labeled as apparatus 100. Said preferred embodiment, illustrated in FIG. 1, is labeled as the machine base for another preferred embodiment labeled as apparatus 100. Characteristics of one preferred embodiment, illustrated in FIG. 1, include being of substantial mass, having a movable base for alignment, and having a variable speed upper spindle. In one embodiment such a machine base is sold by Dynaphth Systems Inc. as a "Dynaphth System 10." Reference may be had, e.g., to U.S. Pat. Nos. 6,296,547, 6,285,035, 6,121,147, 6,080,670 and the like. The entire disclosure of each of these United States patents is hereby incorporated by reference into this specification.

Figure 8:
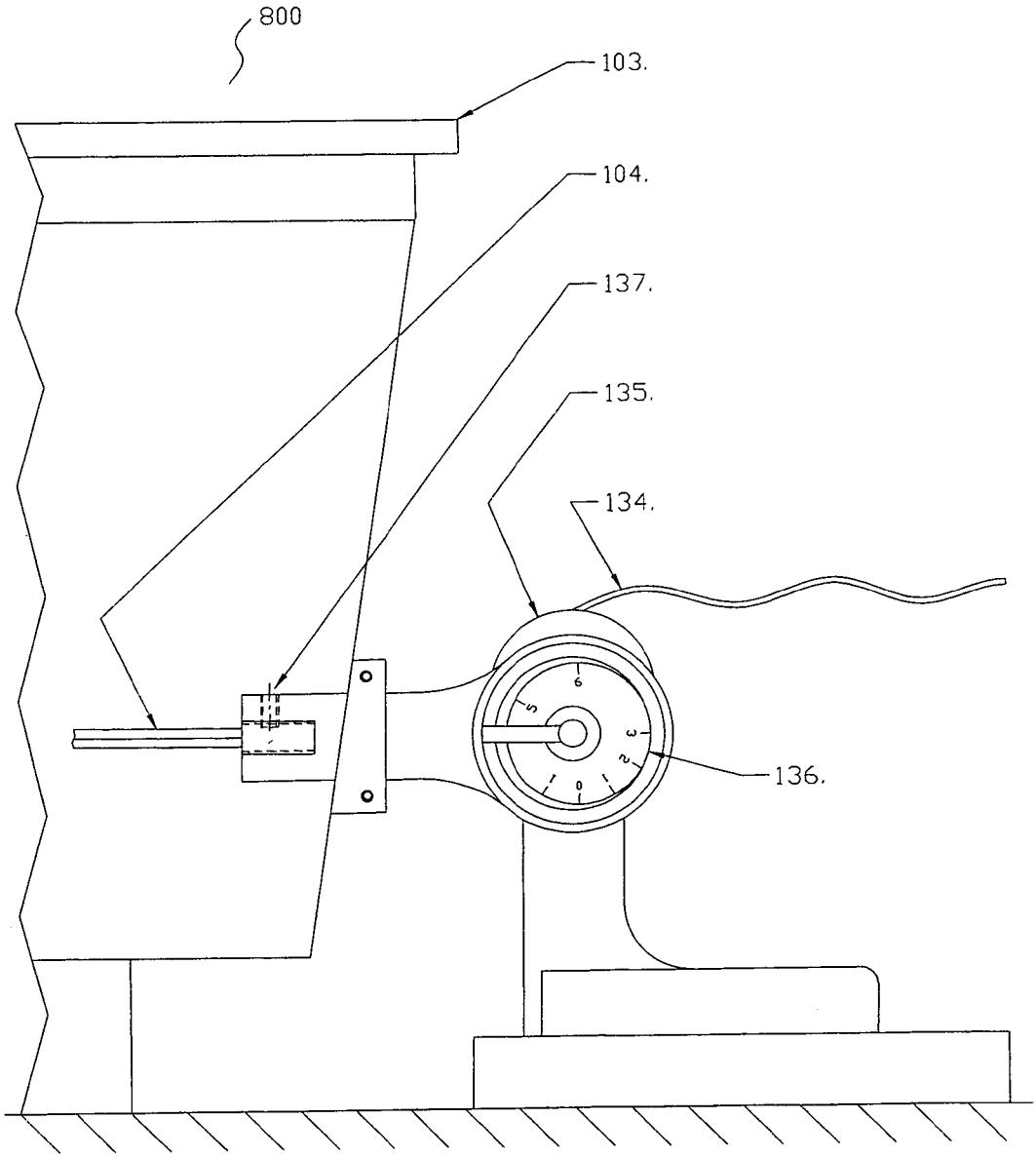
FIG. 8 is a side view of a linear drive unit assembly for use with the apparatus of FIG. 1.

Referring to FIG. 8, it will be seen that one embodiment for use with another embodiment illustrated in FIG. 1 as apparatus 100 consists of adjustable linear eccentric 136, drive unit motor 135, drive shaft 104, polishing tank 103, and the like. One embodiment, illustrated in FIG. 8, has a purpose of providing a high frequency (up to 8.75 KHz) linear oscillatory motion of adjustable stroke length (via linear eccentric 136) to tool body 118 as illustrated in FIG. 3.

In one embodiment, illustrated in FIG. 8, adjustable linear eccentric 136, power cable 134, drive motor 135 and set screw 137 are all components of another embodiment. Said components, as illustrated in FIG. 8 may be purchased as "NSK Electer GX," from Nakanishi Incorporated. Reference may also be had to U.S. Pat. No. 5,464,479. The entire disclosure of this United States patent is hereby incorporated by reference into this specification.

In one embodiment, illustrated in FIG. 8, polishing tank 103 provides a partially enclosed area for polishing a substrate. A portion of the linear drive unit in linear drive unit assembly 800 as well as drive shaft 104 exists inside polishing tank 103.

In one embodiment, illustrated in FIG. 8, characteristics of polishing tank 103 include easily modified (cut through), inexpensive to replace, and resistant to corrosion. In another embodiment materials for said polishing tank include, aluminum, stainless steel and an array of polymers.

In one embodiment, as illustrated in FIG. 8, polishing tank 103 may be made of a Rubbermaid brand plastic. In another embodiment, illustrated in FIG. 8, said polishing tank may be purchased from the Rubbermaid Corporation as "kitchen storage containers." Reference may be had, e.g., to U.S. Pat. Nos. 6,203,034, D427,769, D420,860, D421,678, 5,906,291, 5,904,265 and the like. The entire disclosure of each of these United States patents is hereby incorporated by reference into this specification.

In one embodiment, illustrated in FIG. 8, the linear drive unit assembly is composed of the linear drive unit, and all it components, as well as polishing tank 103, and drive shaft 104. The purpose of this assembly is to provide a controlled linear oscillation to the tool of the preferred apparatus. In one embodiment, linear drive unit, set at a stroke length of 3 millimeters, or +/−1.5 mm about a center line, and a frequency of 4.375 kHz transfers this motion to drive shaft 104 and to tool body 118, as illustrated in FIG. 3A. When the upper spindle 101, illustrated in FIG. 1, rotating at a speed of 60 RPM is lowered to a desired z location, the linear drive unit provides the component of motion that will remove the undesired signature. Said Signature was described earlier in this application.

Figure 9:
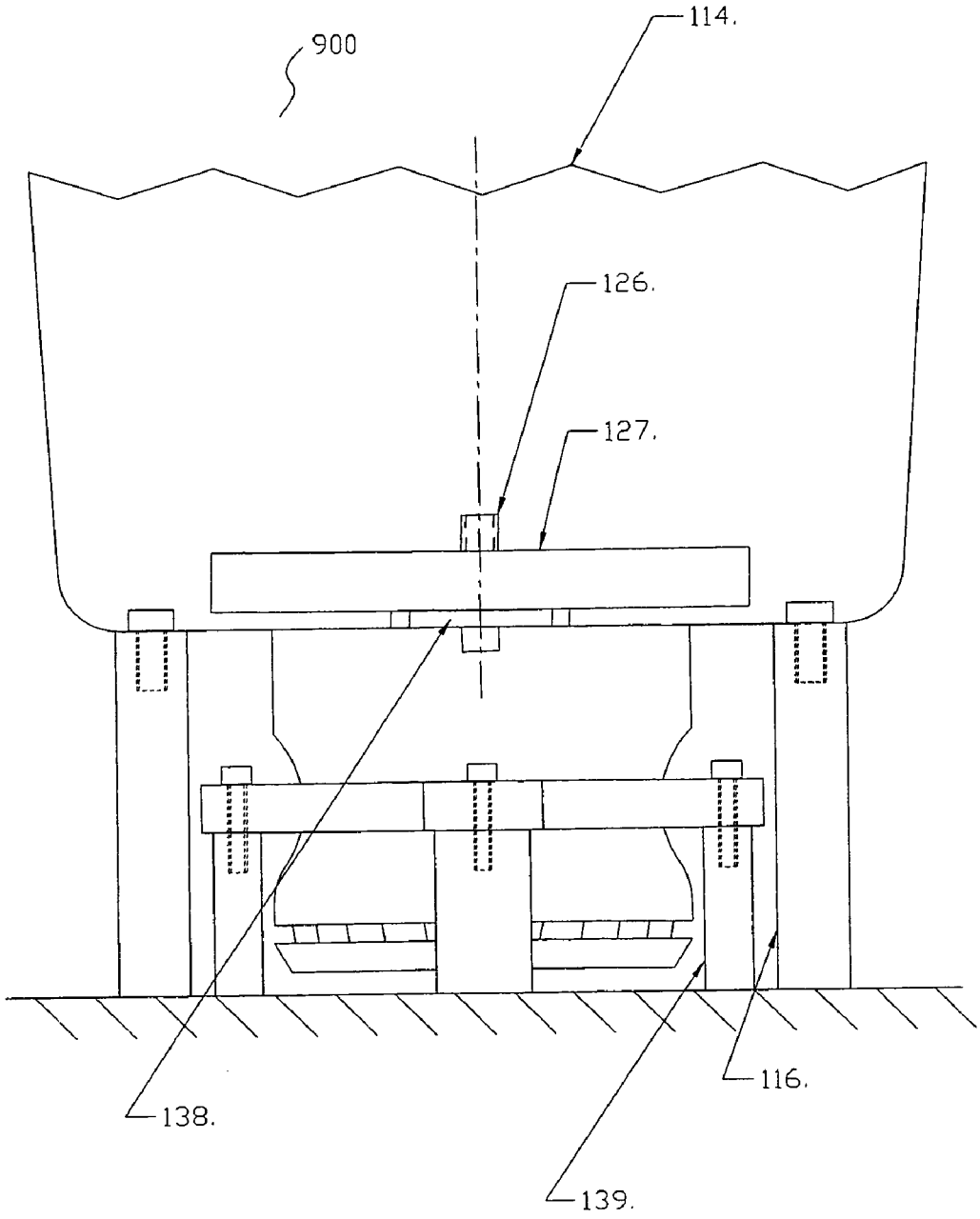
FIG. 9 is a side view of an eccentric drive unit assembly for use with the apparatus of FIG. 2.

Referring to FIG. 9, it will be seen that one embodiment for use with another embodiment illustrated in FIG. 2 as apparatus 200 consists of oscillating platform 127, offset disc 138, eccentric drive unit 117, polishing tank 114 and the like. One embodiment, illustrated in FIG. 9, has a purpose of providing a high frequency (up to 35,000 oscillations per minute) eccentric oscillatory motion to tool body 118 as illustrated in FIG. 3A.

In one embodiment, illustrated in FIG. 9, eccentric offset 138, eccentric drive unit 117, are all components of another embodiment. Said components, as illustrated in FIG. 9 may be purchased as "Palm Sander," from Dewalt Power Tools Co. Reference may be had, e.g., to United States patent publications 20,020,031,992, D408,245, D392,861, D376, 304, 6,035,474 and the like. The entire disclosure of each of these United States patent publications is hereby incorporated by reference into this specification.

As is illustrated in FIG. 9, the eccentric drive unit 117 (illustrated in FIG. 2) uses preset circular offset 138 (illustrated in FIG. 9) which is offset by 1.5 mm in order to create the eccentric motion needed to drive oscillating platform 127. Offset for the eccentric drive unit 138 is currently preset and fixed, however it is not limited to that offset value. Adaptations to the unit can be made to adjust that value.

One embodiment, illustrated in FIG. 9 as the components of the eccentric drive unit have the following characteristics: inexpensive to replace, known durability (greater than 1000 cycles), and provision of a high frequency eccentric oscillation to the preferred tool/backing/pad assembly 300A.

Referring to FIG. 1, one embodiment depicted therein is labeled as apparatus 100. One embodiment, illustrated in FIG. 1, illustrates one preferred apparatus for carrying out one method of the present invention.

Illustrated in FIG. 1, the upper spindle drive unit consists of a drive motor, which rotates upper spindle 101, also illustrated in FIG. 1. The unit is such that it may rotate clockwise or counter clockwise depending on need. Rate of revolution for upper spindle drive unit 109 will also vary upon need. Rate of revolution, in one embodiment, illustrated in FIG. 1 varies from 55 to 5500 RPM. In one preferred embodiment the rate of revolution of the upper spindle drive unit is 60 RPM.

Illustrated in FIG. 1, upper spindle 101 is comprised of a ½ inch tapered C-40 tool holder for use with the Dynaphth System 10. The upper spindle holds a ½-inch adapter in which sits upper spindle set screw 102, also illustrated in FIG. 1. For the purposes of this application the upper spindle adapter and set screw will be discussed further, later in this document.

As is illustrated in FIG. 1, the x and y axis control allows for alignment of upper spindle 101 with drive shaft 104, also shown in FIG. 1.

Figure 10A:
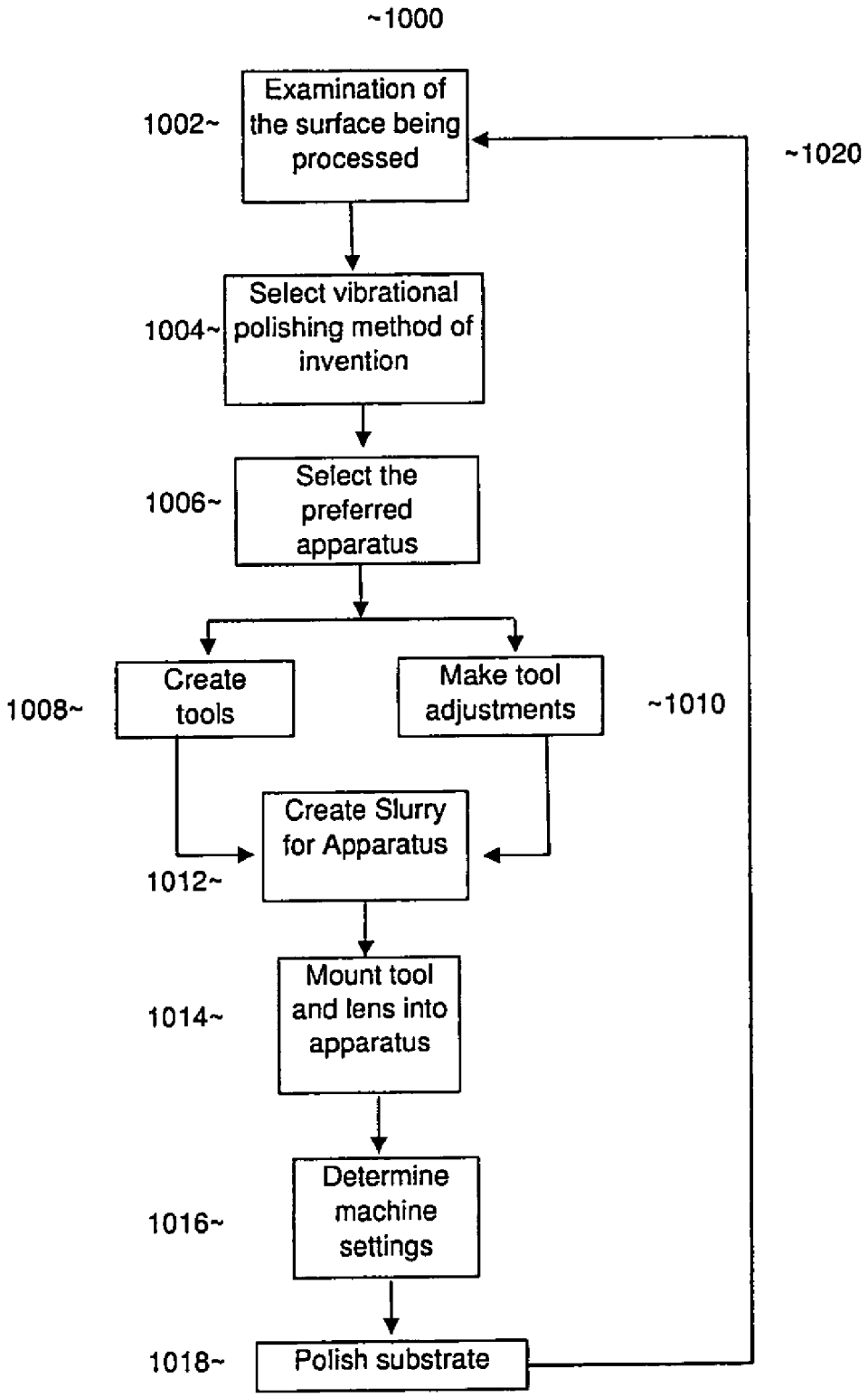
FIG. 10A is a schematic diagram of one preferred process of the invention.

One preferred process 1000 of the invention is illustrated in FIG. 10A. Referring to FIG. 10A, and in step 1002 thereof, the substrate is examined. When examining the surface being processed, the substrate is examined for the presence of subsurface and surface defects such as holes, scratches, fractures, and the like. Methods for examining and evaluating such features of a substrate are well known to those skilled in the art of polishing optics. The form of the surface being processed is also examined as its deviation from a nominal value. Such values as Rt, and Ra are used to evaluate that deviation using the TalySurf profilometer, described earlier in this document. The process begins with an examination of the surface being processed in order that the correct tooling can be made.

Generally tool body 118, as illustrated in FIG. 3A is cut first and may contain a surface in which the contour of the tool is cut to the basic contour of the surface being processed, with tolerances considered for the thickness of the backing and polishing pad. The tool may also be cut with only a portion of the contour of the surface being processed on it.

After the tool is cut, the tool, pad, backing assembly must be made. There are two distinctly different ways which have been utilized thus far in making the tool assembly; however, this process is not limited to just those two methods. Variations of these methods may be performed as well.

After the cycle time has lapsed, the part may be removed from the tank and examined for profile using the Rank Taylor Hobson, Talysurf contact profilometer. Appropriate changes can be made if necessary to the tool/backing/pad 300A (illustrated in FIG. 3A) in order to make additional corrections.

Referring to FIG. 2, one embodiment is labeled as apparatus 200. This apparatus is preferably comprised of upper spindle drive unit 110, z-axis control 111, upper spindle 112, upper spindle mount 113, polishing tank 114, slurry hoses 115, and eccentric drive unit 117.

As is illustrated in FIG. 2, upper spindle drive unit 110 consists of a drive motor, which rotates upper spindle 112. The unit is such that it may rotate clockwise or counter clockwise, depending on need. The rate of revolution for upper spindle drive unit 110 will also vary upon need. The rate of revolution, in one embodiment, illustrated in FIG. 2 varies. In one embodiment, the rate of revolution of the upper spindle drive unit 110 is from about 50 revolutions per minute to about 500 revolutions per minute.

As is illustrated in FIG. 2, upper spindle 110 is comprised of upper spindle 112, and upper spindle mount 113. The upper spindle holds a ½-inch adapter in which sits upper spindle set screw 113, illustrated in FIG. 7.

As is illustrated in FIG. 2, z-axis control 111 allows of the substrate to be lowered onto the tool/backing/pad assembly 300A.

The process begins with an examination of the surface being processed in order that the correct tooling can be made. Generally tool body 118, as illustrated in FIG. 3A, is cut first and may contain a surface in which the contour of the tool is cut to the basic contour of the surface being processed, with tolerances considered for the thickness of the backing and polishing pad. The tool may also be cut with only a portion of the contour of the surface being processed on it. After the tool is cut, the tool, pad, backing assembly must be made.

After the cycle time has lapsed, the part may be removed from the tank and examined for profile using the Rank Taylor Hobson, Talysurf contact profilometer. Appropriate changes can be made if necessary to the tool/backing/pad 300A (illustrated in FIG. 3A) in order to make additional corrections.

Detailed Description of One Preferred Process of the Invention

In one embodiment, illustrated in FIG. 10A, a polishing process is depicted therein. Polishing process 1000, illustrated in FIG. 10A, depicts a sequence of events which is representative of the method of the present invention.

In one embodiment, illustrated in FIG. 10A, the first step of polishing process 1000, is the examination of the surface being processed.

As discussed in previous sections of this application, one purpose of the present invention is to remove a scope of signatures left in or on the surface being processed (not shown). The examination step 1002 of the surface being processed is done so to identify said signatures (not shown).

Examination of the surface being processed in step 1002 is carried out by using information gathered from a variety of measurement equipment. Examples of said types of measurement equipment include contact profilometry, non-contact profilometry, optical profilometry, or visual inspection. Such methods of measuring the surface of substrates is well known to those skilled in the art of optical manufacturing. Reference may be had, e.g., to U.S. Pat. Nos. 6,403,966, 6,341,015, 6,304,330, 6,124,211, 6,414,752, 6,411,915, 6,400,455 and the like. The entire disclosure of each of these United States patents is hereby incorporated by reference into this specification.

In one preferred embodiment, illustrated in FIG. 10A, examination of the surface being processed in step 1002 is done so using visual inspection and contact profilometry. One instrument which uses contact profilometry as a method of measurement is the Talysurf contact profilometer. Reference may be had, e.g., to U.S. Pat. Nos. 5,509,557, 6,140,551, 5,447,466, 4,826,612 and the like. The entire disclosure of each of these United States patents is hereby incorporated by reference into this specification.

Referring again to FIG. 10A, information returned from the contact profilometer often shows deviation from the correct or theoretical form and midspatial waves in the surface being processed. Subsurface damage may be seen typically by visual inspection. Methods of visually inspecting the surface of a substrate are well known. Reference may be had, e.g., to United States patents and 6,400,455, 6,233,350, 6,336,082, 6,324,298, 6,366,357 the like. The entire disclosure of each of these United States patents is hereby incorporated by reference into this specification. While other methods may have advantages in other environments, contact profilometry is preferred in the manufacturing environment. Characteristics of said method of measurement include quick setup, quick time for data retrieval (30 seconds to 3 minutes), and less floor space occupied by the instrument than instruments using other methods such as optical profilometry.

Referring again to FIG. 10A, the step 1002 involving the examination of the surface being processed is important because the amplitude and frequency of the signature on the surface being processed, for example, determines the input variables (pad material, backing material, cycle time, etc.) for steps downstream in the process. Such steps downstream in the process include selecting the preferred apparatus 1006, creating tools 1008 and determining machine settings 1016.

In one embodiment, illustrated in FIG. 10A, signatures (such as subsurface damage, midspatial waves, and form error) which were evaluated in process step 1002, lend themselves to the vibrational polishing method of the present invention. In one embodiment, illustrated in FIG. 10A, the selection of vibrational polishing method in step 1004 is depicted in FIG. 10A. After the surface being processed (not shown), is examined, the vibrational polishing method of the present invention is selected according to the signature and the desired effect (form and surface quality specification) on the surface being processed, as well as the geometry of the surface being processed. Vibrational polishing takes place as a result of a linear motion over an annular section of the surface being processed, as is preferably the case with the apparatus illustrated in FIG. 1. Vibrational polishing also takes place as a result of an eccentric motion over an annular section of the surface being processed, as is the case with the apparatus illustrated in FIG. 2. The vibrational polishing may also take place as a result of a vibrational motion over a localized region of the surface being processed (now shown).

Referring again to FIG. 10A, when selecting the vibrational polishing method in step 1004, one preferred method is by using an eccentric oscillatory motion as used in a preferred apparatus of FIG. 2. Selecting the vibrational polishing method in step 1004 is important because the method is chosen to diminish the presence of a given signature. For example, one preferred embodiment, illustrated in FIG. 2 as apparatus 200 is used in removing gross amounts (0.25 to 10.0 micrometers/minute) of material form the surface being processed (now shown) when tool body 118 (illustrated in FIG. 5) is locked form free rotation. Gross amounts of material are preferably removed in order to remove damage below the surface being processed. The material is removed in an annular fashion in order to make form changes to the surface being processed, as the subsurface damage is uncovered. Characteristics of the eccentric oscillatory motion include a smoother transition from a movement in the positive x-axis direction to the negative x-axis direction (not shown) than the isolated linear motion. According to the selection of the vibrational polishing method in step 1004, the appropriate apparatus is selected in step 1006.

A more detailed description of the apparatuses as they apply to each type of vibrational motion is discussed earlier in this document.

In one embodiment, illustrated in FIG. 10A, occurring in polishing process 1000, the steps of either creating new tools, or making adjustments to existing tools exists therein. After the selection of the preferred apparatus in step 1006, tools must be made or adjusted for the polishing of the substrate. Creating the tools 1008 is a process step which includes creating the tool body 118 (illustrated in FIG. 3A) as well as adding the backing 122, and pad 124 to tool body 118. The method for creating the tool/backing/pad assembly 300A, illustrated in FIG. 3A is discussed earlier in this document. After the substrate has been polished in step 1018, there may be a need for additional polishing in which case modifications can be made to existing tools. Making tool adjustments in step 1010 results form the examination of the surface being processed in step 1002 after the substrate has been polished in step 1018. This is indicated by line 1020 in FIG. 10A. Making tool adjustments in step 1010 is an iterative process initially. For example, to remove the subsurface damage form a substrate (not shown) at least two to three tools are preferably created. Backing 122, and/or pad 124 (illustrated in FIG. 3A) is preferably removed form tool body 118 around the edge of one of the tools so that the polishing process does not remove as much material form the outside of the surface being processed. The absence of backing results in a lesser loading of pad 124 on the surface being processed 124*c* (illustrated in FIG. 3A). The lesser loading results in a lower rate of material removal. This non uniform material removal will result in a change in the overall form the surface being processed.

Referring again to FIG. 10A, at least two or three tools preferably are created because backing 122 (illustrated in FIG. 3A) is removed in different regions on each tool. Backing 122 and or pad 124 may be removed from tool body 118 in either an annular fashion or in sections over the surface 120 of the tool body 118. For example, in FIG. 3B there are several triangular areas in which pad material has been removed from the tool/backing/pad assembly 300B. These areas are indicated by 124*d*. Using the tools in correct sequence, which depends on the initial form and the depth of the damage, results in a corrected form in which the subsurface damage has been removed.

In one embodiment, illustrated in FIG. 10A, as part of polishing process 1000, after tools are created to polish the substrate 1008, slurry is created for use with the preferred apparatus. In step 1012 slurry is created for the apparatus; this process step occurs after tools are created in step 1008, when a substrate is initially polished, but also after making tool adjustments in step 1010, because the slurry should be monitored for contamination, pH levels, baume, etc. Methods for determining the pH and baume are well known to those skilled in the art of optical manufacturing. Appropriate ranges for pH, and degrees baume are discussed earlier in this document. Reference may be had, e.g., to United States patents and 6,413,288,6,372,274, 6,364,744, 6,383,239, 6,395,636, and the like. The entire disclosure of each of these United States patents is hereby incorporated by reference into this specification.

In one embodiment, illustrated in FIG. 10A, as part of polishing process 1000, after slurry is created for the apparatus in step 1012, the tool and substrate are mounted into the apparatus. In step 1014, the tool and substrate are mounted into the apparatus. Process step 1014 must be done with care so as not to introduce damage such as scratches or chips onto the surface being processed. Referring to FIG. 5, tool body 118 is mounted into the apparatus by fastening tool body 118 onto ¼–20 set screw 126 via ¼–20 tap 119*c*. Tool body 118 is fastened until it is tight against oscillating platform 127. This step is important because if tool body 118 is not fastened tightly, it may become loose during the polishing step 1018 (illustrated in FIG. 10A). Referring again to FIG. 5, another concern for keeping tool body 118 fixed tightly to oscillating platform 127 is that no assymetry be introduced onto the surface being processed (not shown). If tool body 118 is not fastened properly or is not tight against oscillating platform 127, the loading of the surface being processed 124*c* onto pad 124 (illustrated in FIG. 3A) which happens during the polishing step 1018 (illustrated in FIG. 10A) will cause tool body 118 to be non-parallel with the surface being, processed (not shown). This added angle introduced will cause asymmetry in the surface being processed (not shown).

Referring again to FIG. 10A, in step 1014, the substrate is also mounted into the apparatus. Typically, optical substrates are mounted onto their own mounting body called blocking bodies prior to the polishing process Materials for mounting optical substrates onto a blocking body include optical pitch or ultraviolet curing optical adhesive. Such methods of blocking optical substrates onto their respective mounting bodies is well known to those skilled in the art of optical manufacturing. Reference may be had, e.g., to U.S. Pat. Nos. 4,502,909, 6,228,289, 6,416,307, 5,723,176, 6,417, 917, and the like. The entire disclosure of each of these United States patents is hereby incorporated by reference into this specification.

Referring again to FIG. 10A, in step 1014, of polishing process 1000, the substrate is mounted into the apparatus. Because the blocking body (not shown) on which the substrate is mounted preferably has a ½ inch or approximately 13 millimeter shaft protruding from its bottom surface (not shown), said shaft fits into upper spindle 112 (illustrated in FIG. 7). The ½ inch shaft has a ¼–20 inch hole tapped into it (not shown) which fastens onto upper spindle mount 113 (illustrated in FIG. 7). It is important that the substrate be mounted tightly as is the case with tool body 118 (illustrated in FIG. 5) so as not to come loose during the polishing step 1018.

In one embodiment, illustrated in FIG. 10A, as part of polishing process 1000, after step 1014 of mounting both the tool and substrate into the apparatus, the machine or apparatus settings are determined. Referring to FIG. 10A, in step 1016 the machine settings are determined. The machine settings include load, cycle time, length of oscillation, frequency of oscillation, etc. Step 1016 is important because the machine or apparatus settings determine or effect the outcome of the surface being processed as occurs as a result of the polishing step 1018 (illustrated in FIG. 10A). For example, determining that a cycle time of 3 minutes is to be executed during the polishing step 1018 will cause a greater removal of material from the surface of the substrate (not shown) than a cycle time of 1 minute to be executed during the polishing step 1018. Load is a machine setting that may be carried out manually or by the use of a computer numerically controlled device. In one embodiment illustrated in FIG. 2, the load is controlled by the counter clockwise rotation of z-axis control Ill. As z-axis control III is rotated, upper spindle 112, and upper spindle mount 113 which hold the substrate in place (not shown) are positioned closer to oscillating platform 127 (illustrated in FIG. 9) which holds the tool (not shown), via ¼–20 set screw 126 (illustrated in FIG. 9). Therefore as the substrate (not shown) comes closer to the tool, contact between the tool and the substrate will occur. Continuing to rotate the z-axis control III (illustrated in FIG. 2) in the same counter clockwise direction after tool/backing/pad assembly 300A and surface being processed 124*c* (illustrated in FIG. 3A) make contact the load or force per area will increase on the surface being processed 124*c* (illustrated in FIG. 3A). Because it is preferred that the method of the present invention be used for many materials, it is also preferred that values for each of the machine settings change depending on the properties of the material type and the geometry of the surface being processed 124*c* (illustrated in FIG. 3A). Such properties include hardness, density, and thermal characteristics. The effects of settings such as load and cycle time on different material types are known to those skilled in the art of optical manufacturing. Reference may be had, e.g., to U.S. Pat. Nos. 6,156,394, 5,961,375, 5,724,189, 5,578,362, 5,498,444 and the like. The entire disclosure of each of these United States patents is hereby incorporated by reference into this specification.

In one embodiment, illustrated in FIG. 10A, as part of polishing process 1000, after machine settings are determined in step 1016, the substrate is polished. Referring again to FIG. 10A, the substrate is polished in step 1018. Polishing the substrate in step 1018 can be an iterative process to determine the correct tool and machine settings in steps 1008, and 1016 respectively which is why line 1020 (illustrated in FIG. 10A), returns from the polishing step 1018 back to the examination step 1002. It is preferred that in the case of removing certain signatures such as subsurface damage the method of the present invention be an iterative process in order that the correct form of the surface being processed be achieved. Because determining the depth and severity of damage below the surface of a substrate is difficult, removing some material from the surface being processed makes it easier to determine the severity of the damage. It is preferred however, that in the case of removing other signatures such as midspatial waves from the surface being processed that a general blending of the entire surface being processed take place. While midspatial waves do occur in localized regions, there is more of a tendency for the surface of a substrate to posses many frequencies of waves over the entire surface as a result of prior operations in the manufacturing process. For this reason, a specific wavelength or frequency, or preferably a range of wavelengths or frequencies can be targeted, using a localized or annular removal, however a blending of the entire surface removes portions from about 25% to about 85% of the wavelengths lying in the midspatial region depending on machine settings determined in step 1016, slurry created in step 1012, tools created in step 1008, and the vibrational polishing method selected in step 1004 (illustrated in FIG. 10A). A discussion of each of these process steps and how they are important to polishing process 1000 respectively is given earlier in this document.

Figure 11:
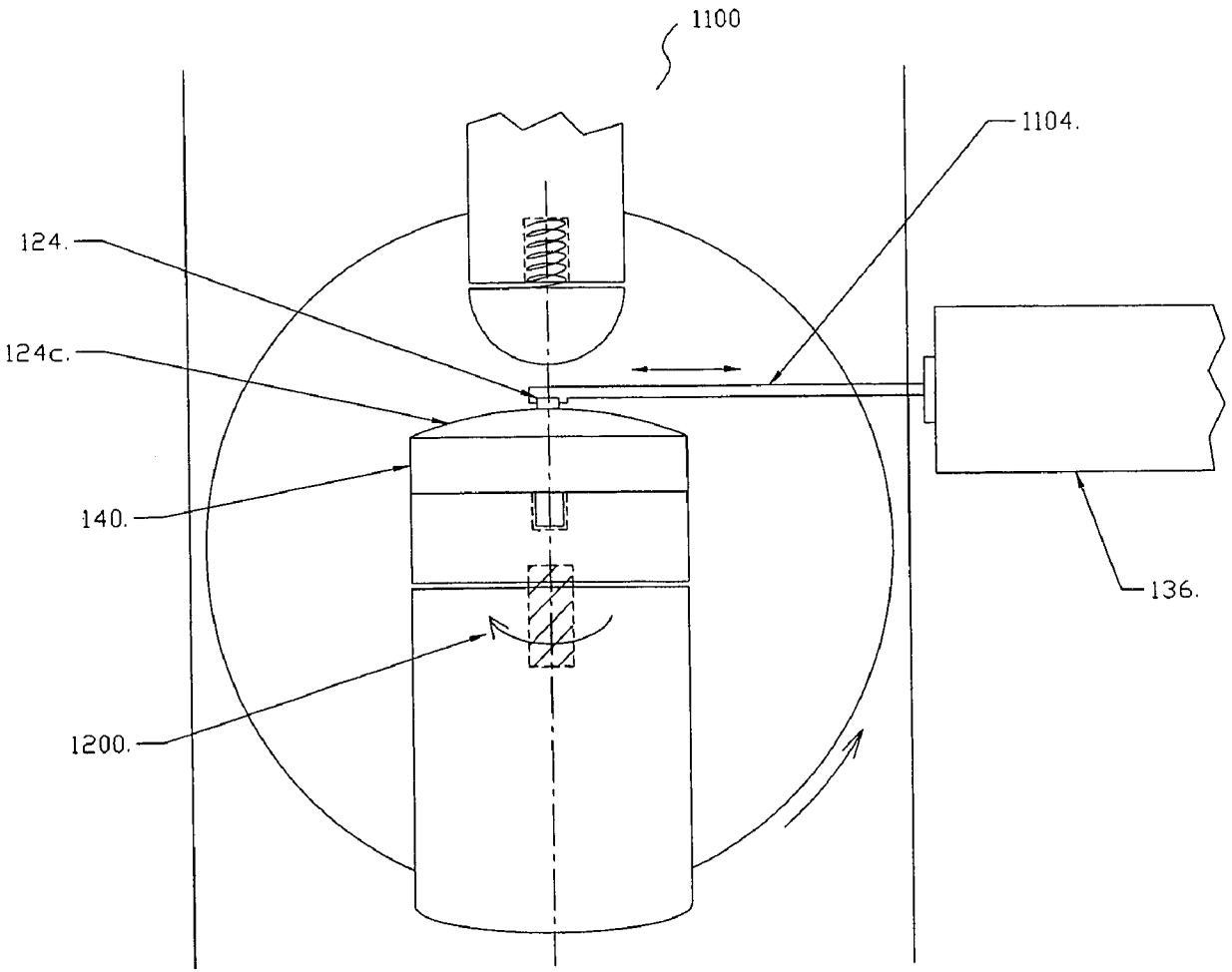
FIG. 11 is a schematic view of another preferred polishing machine.

FIG. 11 is a schematic representation of a preferred process 1100 of the invention in which localized removal of material from a substrate being polished is effectuated. Referring to FIG. 11, a substrate 124C is preferably mounted on a holder 140.

Figure 11A:
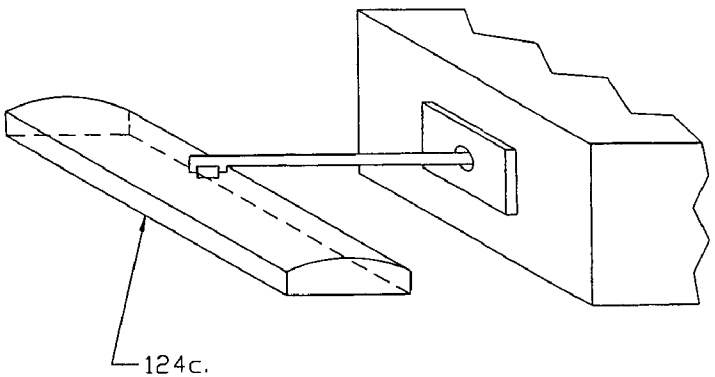
FIGS. 11A, 11B, 11C, and 11D are schematic views of different substrate geometries that may be used in the process of the invention.
Figure 11B:
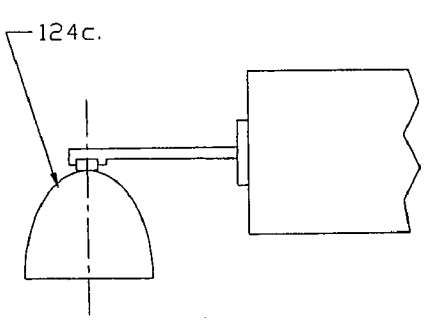

Referring again to FIG. 11, and in the embodiment depicted, the substrate 124C is cylindrical, as is showing in greater detail in FIG. 11A. In another embodiment, the substrate 124C may have an irregular or conformal, an embodiment of which is illustrated in FIG. 11B; and is known to those skilled in the art, conformal relates to an angle-preserving, analytic function of a complex variable. As will be apparent, the substrate 124C may be substantially a shape, regular or irregular in conformation. It is preferred, however, that the substrate 124C contain primarily arcuate surfaces.

Figure 11C:
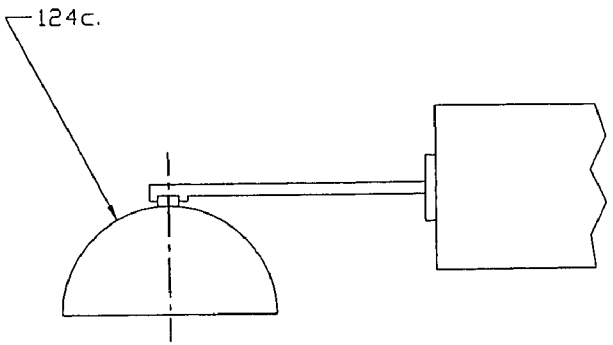
Figure 11D:
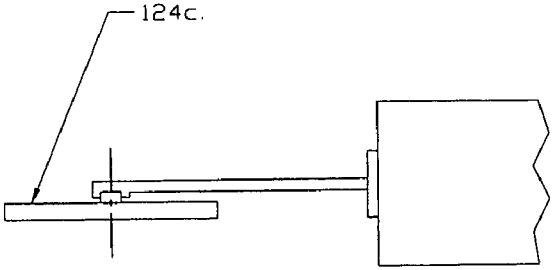

FIG. 11C illustrates a spherical substrate 124C that may be used in the process of this invention. FIG. 11D illustrates a planar substrate 124C which may be used in the process.

In one embodiment, a metrology instrument is used to determine what portion(s) of the substrate 124C should have material removed therefrom, and to what extent such removal should occur; this is discussed elsewhere in this specification. Once these determinations have been made, the process depicted in FIG. 11 may be utilized.

Referring again to FIG. 11, the holder 140 is preferably movable and is preferably adapted to be moved in the X axis, in the Y axis, in the Y axis, or circularly. When the substrate 124C is spherical or a rotational symmetrical asphere, it is preferred that the holder 140 be adapted to rotate. Rotation of the holder 140 may be effectuated by conventional means, such as e.g., a rotating spindle.

In one embodiment, the rate of rotation of the holder 140 may vary, depending upon the position of the material to be removed vis-à-vis the pad 124. Thus, by way of illustration and not limitation, one may increase the dwell time for any particular portion of material to be removed by decreasing the rotation rate of the holder. For a similar process, reference may be had, e.g., to U.S. Pat. No. 5,839,944; the entire disclosure of which is hereby incorporated by reference into this specification.

Referring again to FIG. 11, the substrate 124C may be mounted on the holder 140 in the manner described elsewhere in this specification. See, e.g., step 1014 of FIG. 10A and its accompanying description in this case.

Figure 12:
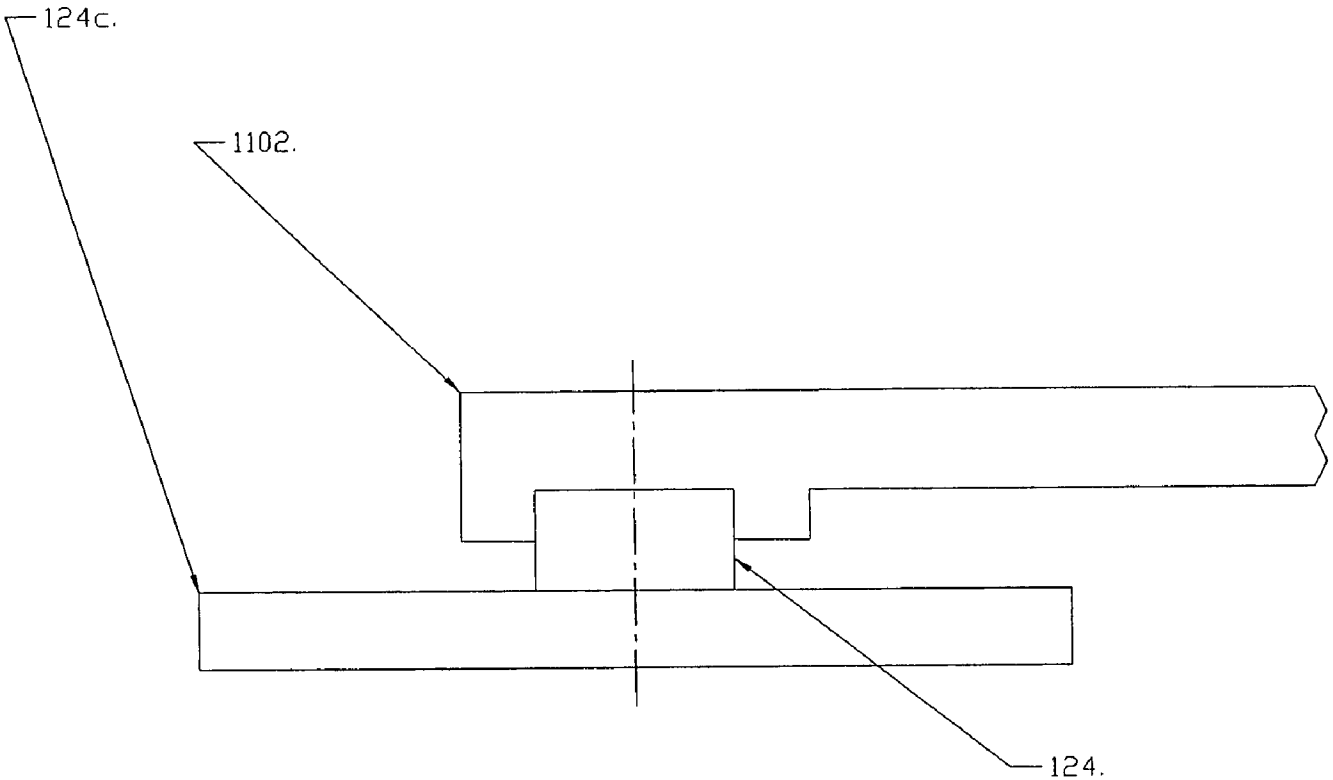
FIG. 12 is a schematic view of a pad and pad holder for use with the apparatus of FIG. 11.

Referring again to FIG. 11, and in the preferred embodiment depicted therein, the pad 124 preferably has certain properties, which are illustrated in FIG. 12.

Referring to FIG. 12, the pad 124 preferably has a maximum cross-sectional dimension 1101 of at least about 0.5 millimeters. In one embodiment, the pad 124 preferably has a diameter of from about 2 to about 6 millimeters.

Referring again to FIG. 12, and in the embodiment depicted therein, it will be seen that pad 124 is connected to a pad holder 1102. It is preferred that the pad 124 be securely mounted in pad holder 1102 so that, during movement of pad holder 1102, the pad 124 does not become detached and accurately translates the motion of the pad holder 1102.

Figure 13:
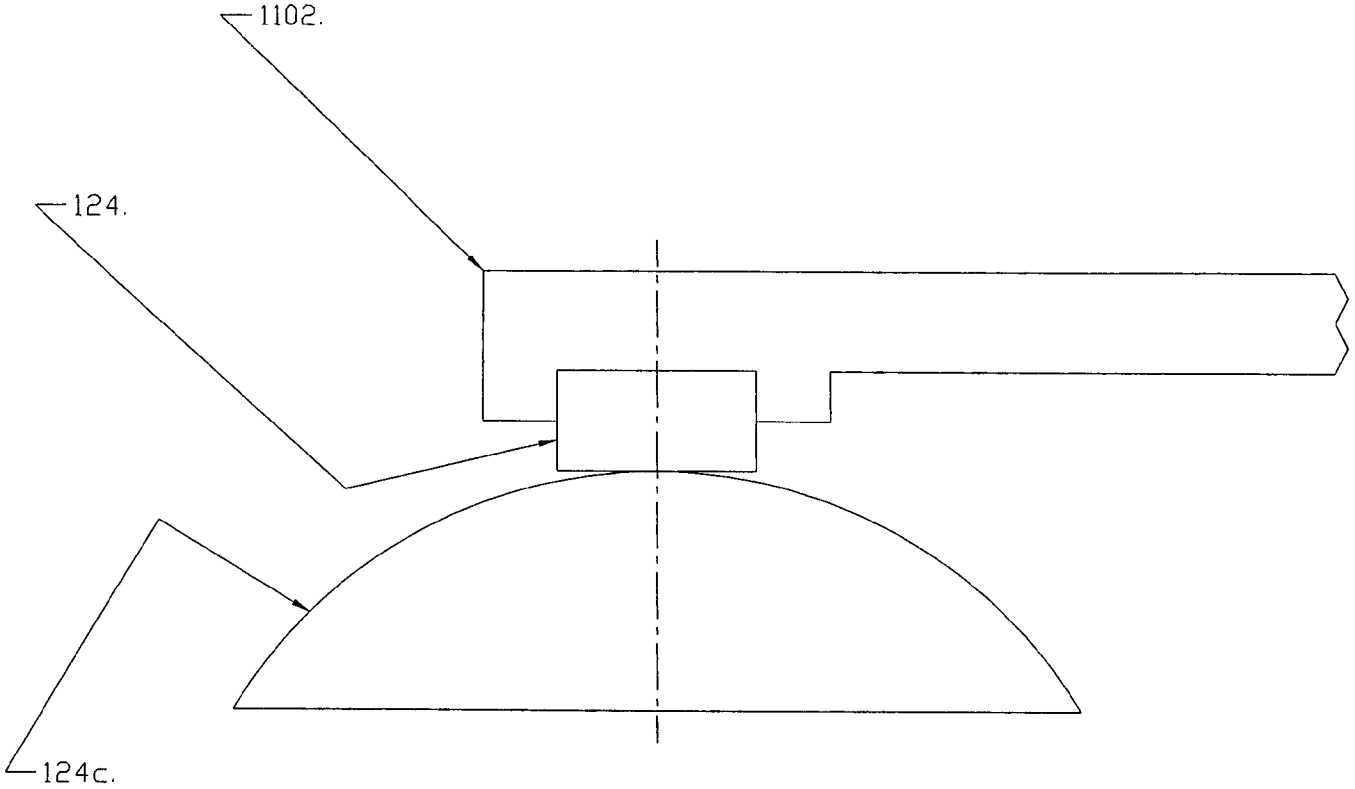
FIG. 13 is another schematic view of a pad and pad holder for use with the apparatus of FIG. 11.

In one embodiment, it is preferred that most of the pad 124 be disposed within the holder 1102, as is illustrated in FIG. 13. Referring to FIG. 13, it will be seen that only a minor portion of the pad 124 extends beyond the end of the holder 1102. It is preferred that the pad 124 extend beyond the end of holder 1102 by a distance which does not exceed about 25 percent of the pad 124's diameter. In one aspect of this embodiment, such distance is preferably less than about 4 millimeters and more preferably less than about 1 millimeters.

Referring again to FIG. 11, the pad holder 1102 and the pad 124 are preferably adapted to oscillate in the X axis, in the Y axis, or in some combination of the X and Y axes. During such oscillatory motion, the pad 124 is preferably tangential to the surface imperfection being removed.

Figure 14:
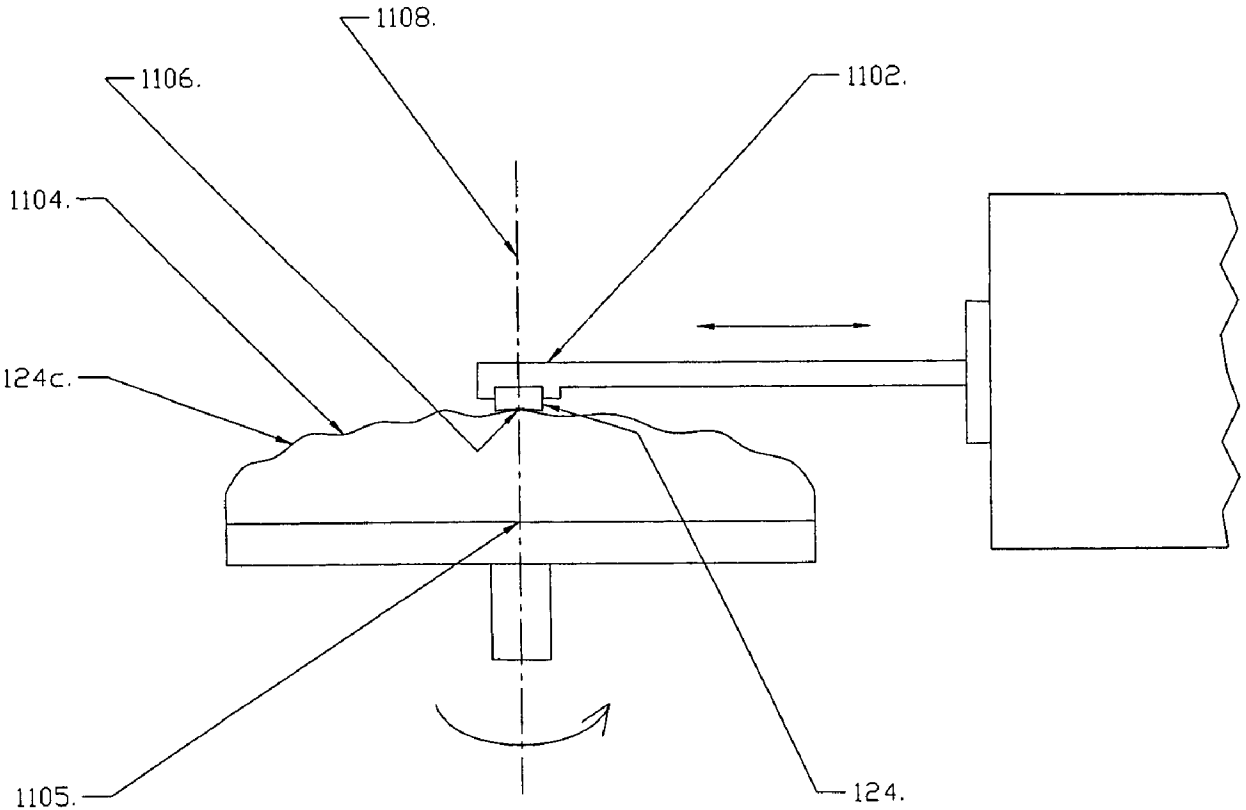
FIG. 14 is a schematic view of a pad for use with the apparatus of FIG. 11 in reference to imperfections on the surface being processed.

This is best illustrated in FIG. 14. Referring to FIG. 14, a substrate 124C is illustrated with an imperfection 1104 at or about point 1106 on the surface of such substrate. At or about such point 1106, an imaginary axis 1105 extends through such imperfection and such point 1106. It is preferred that the axis 1108 of the pad 124 be substantially aligned with the axis 1105 of the substrate 124C, so that the pad 124 is substantially perpendicular to the axis 1105.

As will be apparent, as one is removing more than one imperfection 1104, the orientation of the pad 124 should be changed to maintain such a desired perpendicular orientation. Thus, the pad holder 1102 is adapted to move in the X axis, the Y axis, the Z axis, and angularly in the theta axis. This combination of motions can readily be afforded by a conventional computer numerically controlled (CNC) tool such as, e.g., a five-axis computer controlled milling machine (not shown). Even very complicated shapes can be polished with this combination of motions using state of the art computer controlled machine tools.

In one embodiment, the substrate is preferably contacted with ultrasound energy while it is being contacted with the pad 124. In the embodiment depicted in FIG. 11, such energy is transmitted through rod 1104 and thence through pad 124.

In one embodiment, illustrated in FIG. 11, the ultrasonic energy has a frequency of at least about 20,000 cycles per second and, preferably, from about 20,000 to about 50,000 cycles per second. The ultrasonic energy may be applied continuously during the polishing process, or intermittently; and it may be applied at a constant energy level, or at a variable energy level.

The pressure exerted between the pad 124 and the substrate 124C may be varied during the polishing operation. In one embodiment, such pressure ranges from about 3 pounds per square inch to about 10 pounds per square inch. The device depicted in FIG. 11 allows one to vary such load.

Figure 15:
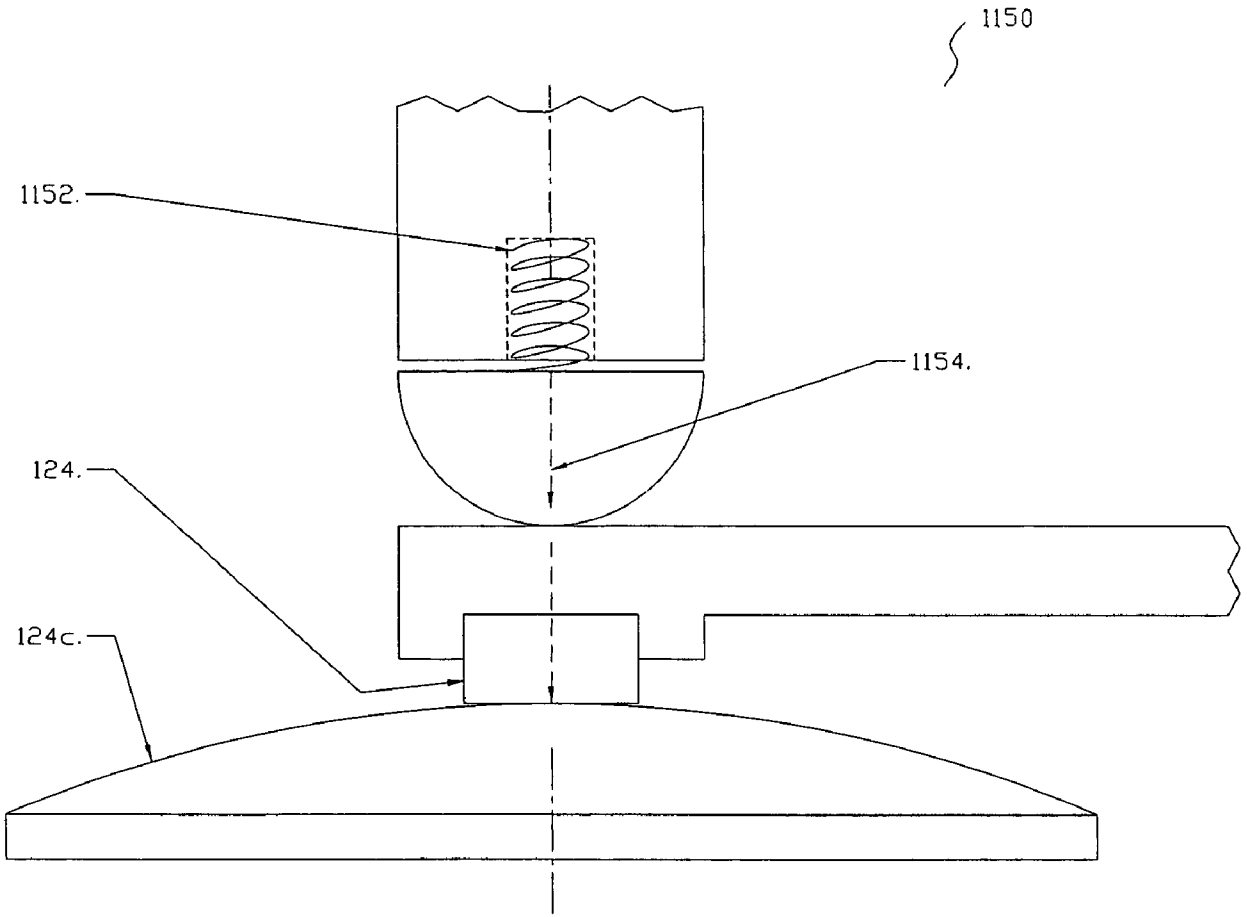
FIG. 15 is a perspective view of one apparatus for use with the apparatus of FIG. 11.

In the apparatus 1150 depicted in FIG. 15, means are provided for varying the load between the pad 124 and the substrate 124C. In this embodiment, a spring 1152 is caused to load such pad 124 against the substrate 124C by means of road 1154. Other means of imparting a variable load between the pad 124 and the substrate 124C also may be used.

A Preferred Process of the Invention

In this section of the specification, one preferred process is described that involves the use a software program to control the various processing steps and procedures that are performed by the apparatus used in the polishing process.

In one embodiment, a software program (not shown) controls the operation of the apparatus 100 illustrated in FIG. 1 and the apparatus 200 illustrated in FIG. 2. One preferred process that may be used to control apparatus 100 and apparatus 200 is illustrated as a flowchart in FIG. 16. This process provides both a software interface to control machine functions and means for collecting process data from the machine that is used for process optimization.

Figure 16:
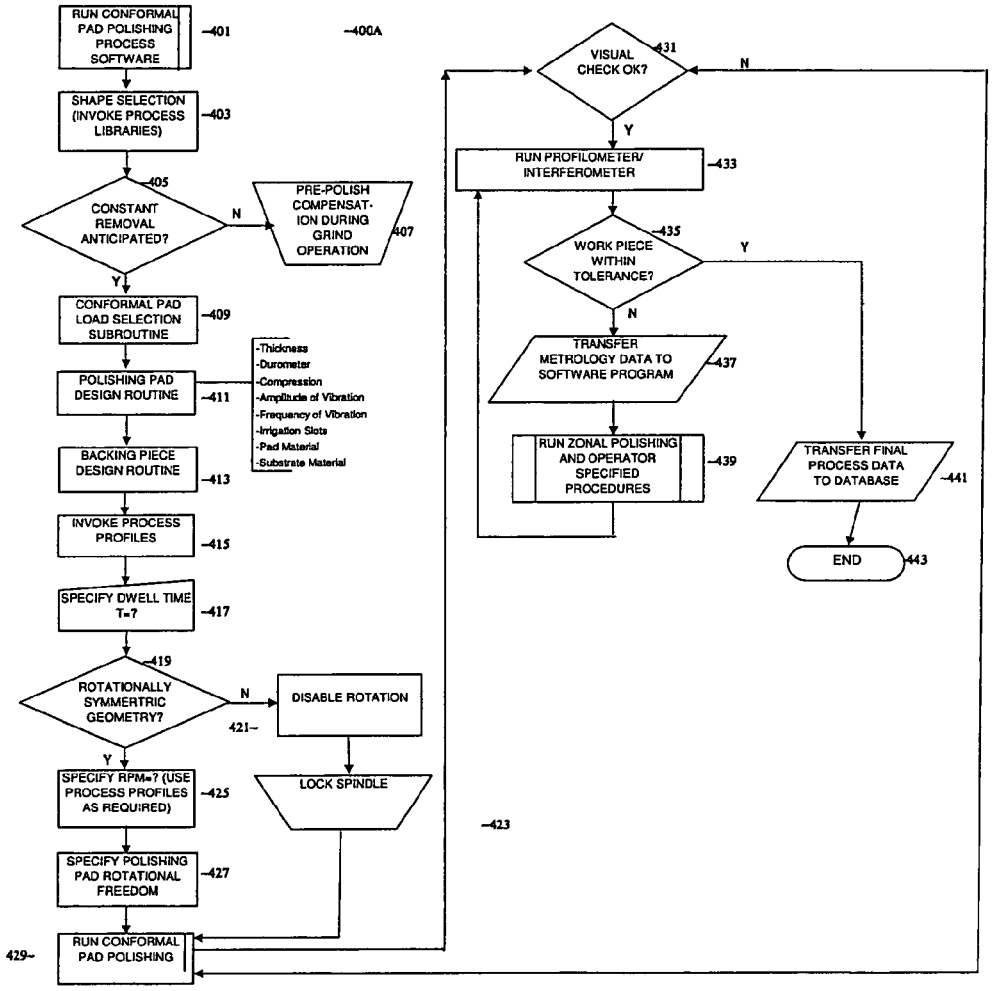
FIGS. 16, 17, 18, and 19 are each a flow chart of a preferred process of the invention.

Referring to FIG. 16, the preferred process depicted preferably utilizes a software algorithm to control the conformal pad polishing process and associated apparatus. In this embodiment, the control software preferably contains a graphical user interface to provide for ease of use. The graphical user interface preferably contains standard components that are easily recognizable to the machine operator, usually an optician.

To execute the software program, the machine operator will execute a run program command in step 401 using an icon contained in the graphical user interface. The software program will guide the machine operator through the setup and operation of the polishing apparatus 100 and 200.

In step 403, the machine operator is offered a menu of geometric shapes that are representative of the workpiece that is to be polished. This menu of geometric shapes is linked to a process library. The process library is a database contained in the software that contains process parameters that are required for various workpieces.

Once the machine operator selects the proper geometric shape in step 403, the machine operator is prompted with a question in the software application. In step 405, the machine operator is asked if constant material removal of the workpiece is expected. This answer is based on the judgement of the operator, usually an optician. If the machine operator indicates in step 405 that constant removal is not anticipated (a NO answer), the machine operator will perform a manual process of pre-polish compensation during the grinding operation in step 407. The grinding operation is typically performed on a workpiece prior to the polishing process to achieve a rough geometry that can be properly polished. If the machine operator indicates in step 405 that constant removal is anticipated (a YES answer), the software will execute a conformal pad load selection subroutine in step 409. This subroutine will provide the machine operator with pressure settings that are either manually or automatically entered into apparatus 100 or apparatus 200. These pressure settings are used to apply a load to the conformal pad in apparatus 100 or apparatus 200 that is appropriate to the workpiece and polishing operation.

Once the appropriate load settings are determined in step 409, the machine operator is guided through a series of questions that will determine the attributes of the polishing pad to be used. These questions are modified and added to based on new process data that is collected by the software and the machine operator in the normal course of polishing workpieces. The design attributes of the polishing pad that are important for setup of the polishing apparatus 100 and 200 include thickness, durometer, compression, amplitude of vibration, frequency of vibration, irrigation slots, pad material, substrate material, as well as occasional workpiece specific parameters.

Once the polishing pad is designed in step 411, the backing piece design is performed in the software in step 413. The backing piece is typically a rigid or semi-rigid material that is machined to conform to the geometry of the workpiece and polishing pad combination.

Upon the completion of the polishing pad and backing piece design algorithms, the software will prompt the user to select a process profile in step 415 that is appropriate, in the judgement of the machine operator, to the workpiece. These process profiles are database files of machine settings for apparatus 100 and apparatus 200 that have been developed over time for the various polishing procedures and workpiece geometries. The machine operator is provided with a short description of each of the process profiles in step 415 to assist in the selection of the process procedure that is appropriate to the workpiece.

Upon selecting the process profile in step 415, the machine operator specifies the dwell time in step 417. The dwell time is the time period that the conformal pad polisher makes physical contact with the workpiece, and in so doing, is removing material from the workpiece. The machine operator may elect to determine the dwell time with the assistance of information contained in the process profiles of step 415.

The machine operator is next asked if the workpiece is of a rotationally symmetric nature in step 419. A rotationally symmetric workpiece requires the addition of an angular rotation to the workpiece for polishing. If the machine operator indicates to the software that the workpiece is not rotationally symmetric (a NO answer), step 421 will disable the rotation of the workpiece, and step 423 will lock the spindle 101 in apparatus 100 or spindle 112 in apparatus 200. If the machine operator indicates that the workpiece is of a rotationally symmetric geometry (a YES answer in step 419), the machine operator will be asked to specify the angular velocity of the workpiece in step 425. The machine operator may elect to determine the angular velocity with the assistance of information contained in the process profiles of step 415.

Still following the software processing that resulted from a YES answer in step 419, the machine operator is asked in step 427 to specify the rotational freedom of the polishing pad. The polishing pad, depending on the specific polishing procedure under consideration, may be either locked in place, allowed to move freely about an n-dimensional axis, or be a combination of free motion, locked position, and clutched/braked motion. The machine operator may elect to determine the rotational freedom in step 427 with the assistance of information contained in the process profiles of step 415.

Upon the completion of step 427 in the case of a rotationally symmetric geometry in step 419, or the completion of step 423 in the case of a non-rotationally symmetric geometry in step 423, apparatus 100 or, equivalently, apparatus 200 are ready to begin the polishing process, and the software will initiate a sequence to begin conformal pad polishing in step 429.

Upon completion of the dwell time specified previously in step 417, the software will cycle down and power off the apparatus 100 or apparatus 200. The machine operator will then be provided with a visual, and optionally and audible, signal that it is safe to remove the workpiece from the polishing apparatus and perform a visual inspection that is known to those skilled in the art. This visual inspection is performed in step 431, and will determine the next steps to be performed by the software algorithm. In step 431, if the operator performs a visual inspection of the workpiece, and determines that the conformal pad polishing of step 429 was not completed adequately, the machine operator will indicate to the software that the workpiece did not pass visual inspection (NO PASS flag), and the software will initiate an iterative run conformal pad polishing sequence, and return to step 429. The visual inspection performed by the machine operator is a manual process, the results of which are manually entered into the software using a graphical user interface. The data entry is a "PASS" or "NO PASS" flag that will instruct the software to execute the appropriate next steps. If the workpiece passes the visual inspection in step 431, the machine operator will run a profilometer or interferometer test in step 433 to determine if the workpiece is within the tolerance required by the customer's specifications. The machine operator may elect to use a profilometer if a 2-dimensional plot of the surface defects of the workpiece is adequate, or may optionally elect to use an interferometer if a 3 dimensional plot of the workpiece is required. If the results of the profilometer/interferometer test of step 433 indicate that the workpiece is within tolerance, a YES answer is entered into the software at step 435, the interferometer/profilometer test data is transferred into a database in step 441, and the polishing process in ended with the resulting finished part. If the workpiece is not within tolerance in step 435, the data from the profilometer/interferometer test of step 433 (also known by those skilled in the art as metrology data) is transferred to the software program in step 437. The software will then provide routines for zonal polishing, as described in FIG. 16, or allow for machine operator specified instructions. Upon completion of zonal polishing and machine operator specified procedures in step 439, the profilometer/interferometer tests are re-run in step 433, and the tolerance of the workpiece is again determined in step 435. The outcome of step 435 will be either completion of the polishing process through steps 441 and 443, as previously described, or another iteration of steps 437 and 439 until the workpiece is within tolerance, the polishing process is ended with the resulting finished part.

In one embodiment, a software program controls the operation of the apparatus illustrated in FIG. 11, 11*a*, 11*b*, 11*c*, 11*d*. The algorithm to control the apparatus is represented as a flowchart in FIG. 17. This algorithm both provides a software interface to control machine functions, and additionally collects process data from the machine that is used for process optimization.

Figure 17:
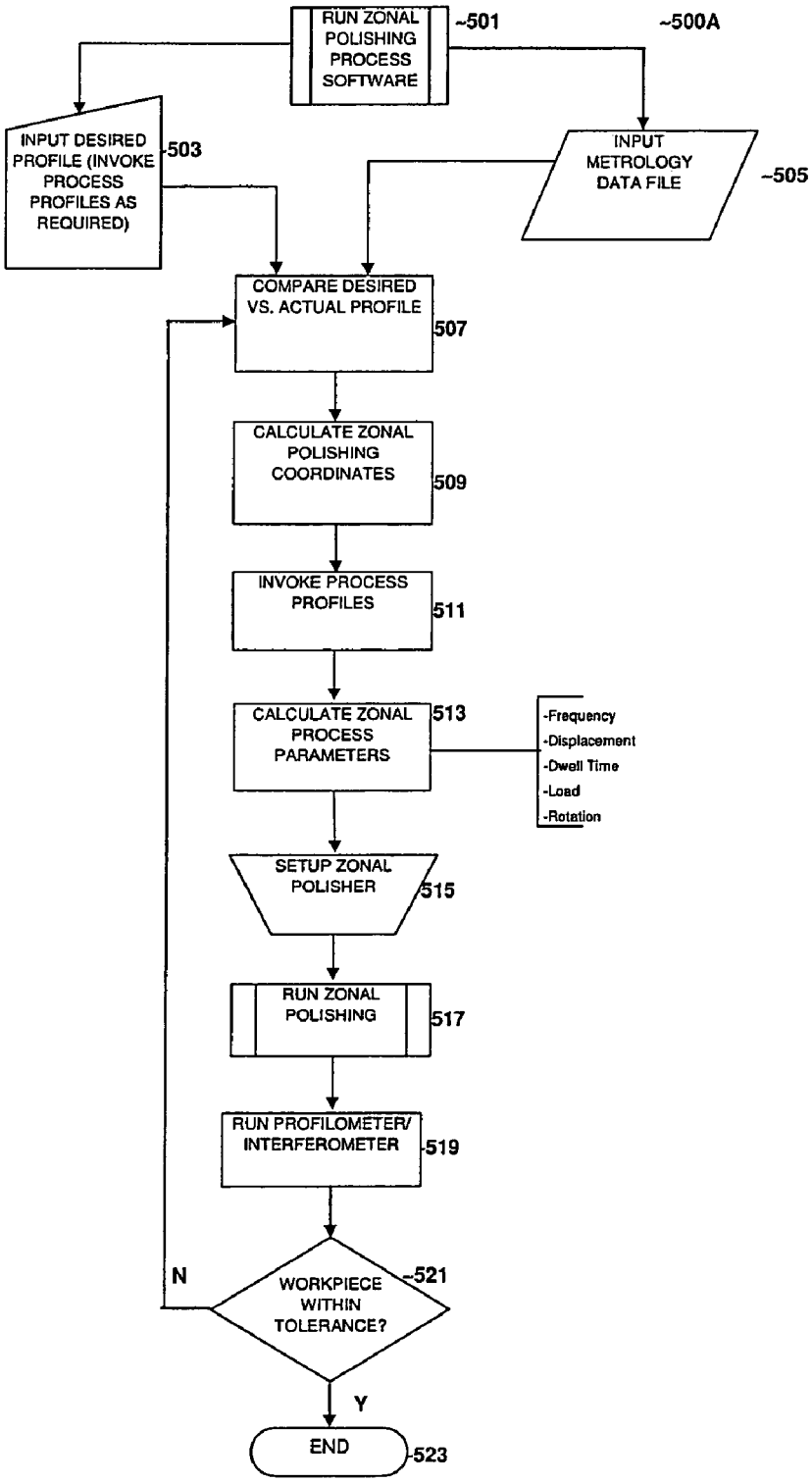
Figure 18:
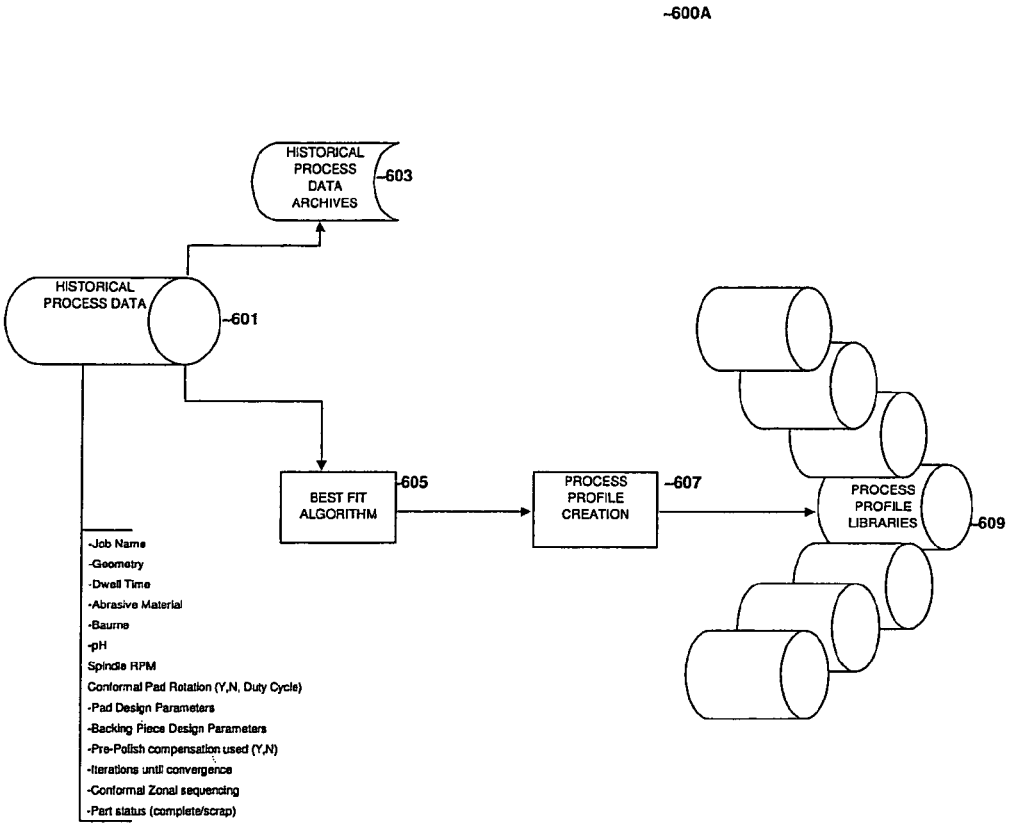

Referring to FIG. 17, the software algorithm to control the zonal polishing process and associated apparatus is described. The control software contains a graphical user interface to provide for ease of use. The graphical user interface contains standard components that easily recognizable to the machine operator, usually an optician.

The software algorithm described in FIG. 17 automates the zonal polishing process. This automation reduces the labor time required per part, reduces rework and scrap, and provides for easily reproducible workpiece process parameters. The zonal polishing process is used to polish specific areas of the workpiece that are determined in step 435 to be out of tolerance. The zonal polishing process is performed after completing the conformal pad polishing of step 429, or other similar polishing procedures that are known by one skilled in the art.

To execute the software program, the machine operator will execute a run program command in step 501 using an icon contained in the graphical user interface. The software program will guide the machine operator through the setup and operation of the polishing apparatus of FIGS. 11, 11*a*, 11*b*, 11*c* and 11*d*.

In step 505, metrology data collected in step 433 and 437 is loaded into the software. This metrology data is compared to the desired workpiece profile in step 503. This comparison of desired versus actual workpiece profile is used by the software program to determine the coordinates and polishing parameters required for the zonal polishing process. This comparison is performed in step 507. The results of this comparison are used by the software to calculate the coordinates of areas that require zonal polishing. This calculation is performed in step 509. Once this calculation is performed, the software will retrieve the process profile that was previously selected in step 415. The retrieval of this previously selected process profile is done at step 511. The data from the selected process profile is used in conjunction with the actual metrology data loaded in step 505 to calculate the process parameters required for zonal polishing. These parameters include frequency, displacement, dwell time, load, rotation, and machine operator defined parameters. Once these process parameters are calculated in step 513, the zonal polisher is setup by the machine operator at step 515 in preparation for zonal polishing. In step 517, the zonal polishing is started, and run for the time specified or calculated in step 513. Once the zonal polishing is complete, the workpiece is placed in a profilometer or interferometer in step 519, and the data collected at this step is used to determine if the workpiece is within tolerance at step 521. If the workpiece is within the required tolerance, the polishing process is ended with the resulting finished part. If the workpiece is not within the required tolerance, the software.

In the embodiments of the software programs that are used to control the apparatuses described in FIGS. 1, 2 and 11, 11*a–d*, it is desirable to provide intelligence to the software using a database to store historical and theoretical process data and parameters. It is further desired to create an algorithm that can be user modified that processes this data to provide "best fit" process parameters to the machine operator during machine setup and processing.

FIG. 187 describes one such best fit algorithm. In FIG. 17, historical process data is stored in a database indicated by data component 601. This historical process data has been collected at steps 433 and 519, or entered manually or collected from another source. The historical process data includes such items as job name, geometry, dwell time, abrasive material used, baume, pH, spindle RPM, conformal pad rotational freedom, pad design parameters, backing piece design parameters, pre-polish compensation data, interations performed to achieve convergence, the sequencing of conformal and zonal polishing, the final status of the parts, and other process parameters that may be useful to the machine operator.

This historical process data of 601 is sent to a best fit algorithm in step 605 that determines optimal process parameters from similar historical process data. This algorithm may be changed by the machine operator or another who is familiar with the processing of the workpiece. These changes may be performed periodically to optimize the best fit algorithm. Once the best fit algorithm in step 605 completes, a process profile is created in step 607. This profile is given a name by either the software program or the user of the software, and contains process parameters that are optimal for specific polishing conditions such as geometry, material, and other parameters that are specific to the workpiece. Once new profiles are created, they are stored in process profile libraries 609. These libraries are contained in a database, and provide a convenient way to group numerous process profiles by common categories.

Figure 19:
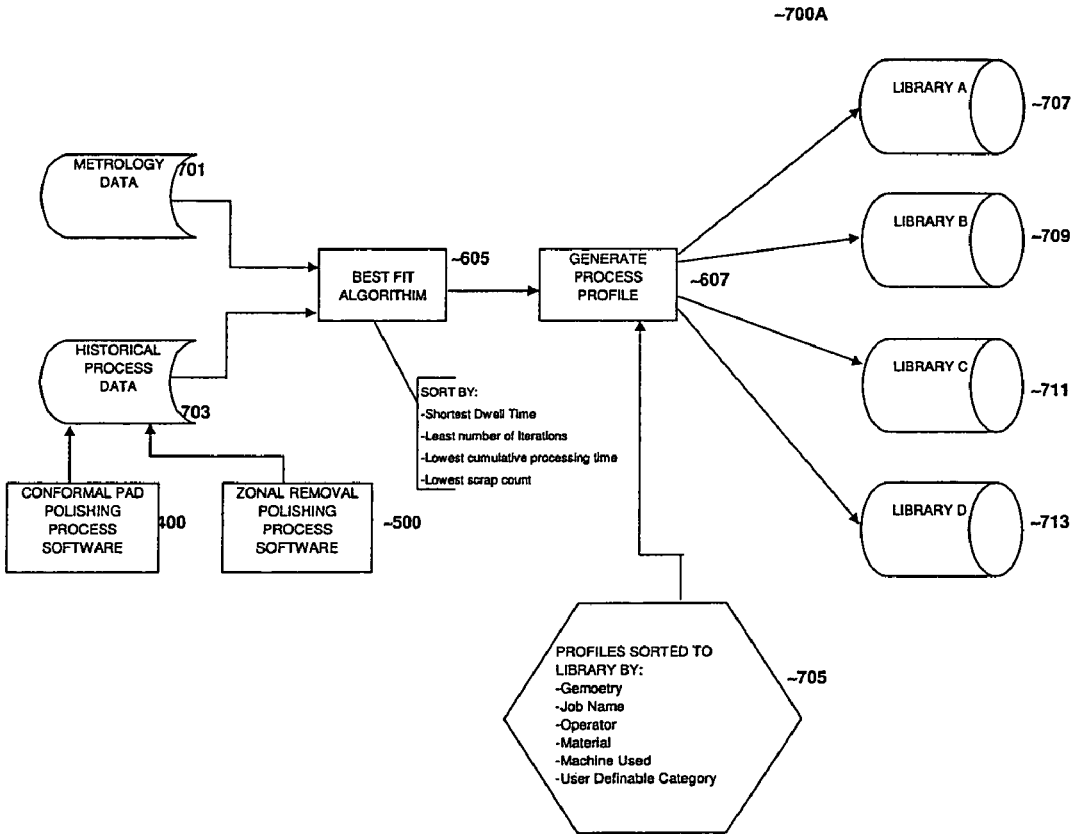

In FIG. 19, the data flow of process data is described. Actual data from past polishing processes is collected in the form of metrology data 701 that was collected at steps 433 and 519. Additionally, historical process data 703 is collected from the software programs used to control the conformal pad polishing process, previously described in FIG. 15 (400), and the zonal polishing process software previously described in FIG. 16 (500).

The historical process data of 703 and the metrology data of 701 are processed by the best fit algorithm previously described in step 605. The best fit algorithm determines the optimal processing parameters by selecting the shortest dwell time, the least number of iterations, the lowest cumulative processing time, the lowest scrap count, and other desirable attributes that are unique to the workpiece. The best fit algorithm of step 605 is then used to generate a process profile, previously described in step 607. Once new profiles are created, they are stored in process profile libraries 609. These libraries are contained in a database, and provide a convenient way to group numerous process profiles by common categories. The process profile libraries, further represented as data items 707, 709, 711 and 713 may be numerous and may be modified, combined, changed or deleted over time as new process data enters the software and is processed.

Having illustrated and described embodiments of this invention in some detail, it will be understood that these descriptions and illustrations have been offered by way of example only and that the invention claimed is to be limited in scope only by the appended claims.

What is claimed is:

1. An apparatus for polishing a substrate comprised of an optical surface, wherein said optical surface has a centerline, said apparatus is comprised of a polishing pad assembly comprised of a polishing pad, and means for oscillating said polishing pad about said centerline such that said oscillations occur within 1.5 mm of said centerline at a frequency of from about 0.25 KHz to about 50 KHz, while simultaneously contacting said pad with at least 90 percent of said optical surface.

2. The apparatus as recited in claim 1, wherein said means for oscillating said polishing pad is comprised of means for moving said polishing pad in a non-linear motion.

3. The apparatus as recited in claim 2, further comprising moving said optical surface.

4. The apparatus as recited in claim 1, wherein said polishing pad assembly is comprised of a backing disposed within a tool body, wherein said tool body is comprised of a surface that is substantially congruent with said optical surface.

5. The apparatus as recited in claim 1, wherein said means for oscillating said polishing pad is comprised of means for moving said polishing pad in a linear motion.

6. The apparatus as recited in claim 1, further comprising means for rotating said polishing pad.

7. The apparatus as recited in claim 1, further comprising means for contacting said polishing pad with said optical surface, for maintaining a uniform pressure on said optical surface and across said optical surface, and for varying the amount of pressure applied by said polishing pad to said optical surface.

8. The apparatus as recited in claim 1, further comprising means for holding said substrate and allowing said substrate to rotate when it is contacted with said polishing pad.

9. The apparatus as recited in claim 1, further comprising means for holding said substrate and preventing said substrate from rotating when it is contacted with said polishing pad.

10. The apparatus as recited in claim 1, wherein said polishing pad is comprised of a bottom surface, and wherein said bottom surface is comprised of a multiplicity of recesses.

11. An apparatus for polishing a portion of an optical surface, wherein said optical surface has a centerline, said apparatus is comprised of a polishing pad comprised of a surface that has a surface area that is less than about 0.15 times as great as the surface area of said optical surface, and means for oscillating said polishing pad about said centerline such that said oscillations occur within 1.5 mm of said centerline at a frequency of from about 0.25 to about 50 KHz.

12. The apparatus as recited in claim 11, further comprising a fixture for holding said polishing pad to said optical surface and for providing uniform pressure to said polishing surface.

13. The apparatus as recited in claim 12, further comprising means for varying the amount of said uniform pressure applied to said polishing surface.

14. The apparatus as recited in claim 11, comprising means of oscillating said polishing pad in a linear motion.

15. The apparatus as recited in claim 11, comprising means for oscillating pad in a non-linear motion.

16. The apparatus as recited in claim 11, further comprising means for rotating said optical surface while it is contiguous with said polishing pad.

17. The apparatus as recited in claim 11, further comprising means for holding said optical surface in a substantial tangential relationship with regard to said polishing pad.

18. The apparatus as recited in claim 11, further comprising means for subjecting said polishing pad to ultrasonic energy.

19. The apparatus as recited in claim 1, comprised of means for oscillating said polishing pad at a frequency of a least 250 hertz.

20. The apparatus as recited in claim 11, comprised of means for oscillating said polishing pad at frequency of at least 250 hertz.

* * * * *